US012163744B2

(12) United States Patent
Nita et al.

(10) Patent No.: US 12,163,744 B2
(45) Date of Patent: Dec. 10, 2024

(54) HEAT EXCHANGER

(71) Applicant: DENSO CORPORATION, Kariya (JP)

(72) Inventors: Satoshi Nita, Kariya (JP); Yusuke Takagi, Kariya (JP); Kenshiro Muramatsu, Kariya (JP); Isao Tamada, Kariya (JP); Shogo Kawaguchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 356 days.

(21) Appl. No.: 17/308,655

(22) Filed: May 5, 2021

(65) Prior Publication Data

US 2021/0254907 A1 Aug. 19, 2021

Related U.S. Application Data

(63) Continuation of application No. PCT/JP2019/043484, filed on Nov. 6, 2019.

(30) Foreign Application Priority Data

Nov. 13, 2018 (JP) ..... 2018-212962
Oct. 2, 2019 (JP) ..... 2019-182356

(51) Int. Cl.

| | |
|---|---|
| ***F28D 9/00*** | (2006.01) |
| ***F28F 3/02*** | (2006.01) |
| ***F28F 13/12*** | (2006.01) |
| *F25B 39/04* | (2006.01) |

(52) U.S. Cl.

CPC ..... *F28F 13/12* (2013.01); *F28D 9/005* (2013.01); *F28F 3/027* (2013.01); *F25B 39/04* (2013.01); *F28F 2215/00* (2013.01)

(58) Field of Classification Search

CPC .... F28F 13/12; F28F 3/02; F28F 3/027; F28F 2215/00; F28F 2215/04; F28F 3/025; F28F 3/046; F28F 2215/08; F28D 9/00; F28D 9/0093; F28D 9/005; F28D 9/0056;

(Continued)

(56) References Cited

U.S. PATENT DOCUMENTS 2,937,856 A 5/1960 Thompson et al.
4,332,293 A * 6/1982 Hiramatsu ..... F28D 1/0535 165/DIG. 486

(Continued)

FOREIGN PATENT DOCUMENTS

CN 1509403 A 6/2004
CN 102155851 A 8/2011

(Continued)

*Primary Examiner* — Harry E Arant
(74) *Attorney, Agent, or Firm* — Harness, Dickey & Pierce, P.L.C.

(57) ABSTRACT

A heat exchanger includes an inner fin arranged in a refrigerant passage. The inner fin has side wall portions formed so as to extend in a predetermined direction and arranged parallel to each other. A gap formed between the side wall portions facing each other is a passage portion through which refrigerant flows. Each of the side wall portions has a plurality of openings arranged in the predetermined direction. An inclined surface inclined with respect to the predetermined direction is formed in a part of the side wall portion located between the openings adjacent to each other.

13 Claims, 23 Drawing Sheets

(58) Field of Classification Search
CPC ..... F28D 2021/0068; F28D 2021/007; F25B 39/04; F25B 2339/043
See application file for complete search history.

(56) References Cited

U.S. PATENT DOCUMENTS

| | | | | |
|---|---|---|---|---|
| 4,434,842 | A * | 3/1984 | Gregory | F28F 3/027 165/166 |
| 4,899,808 | A | 2/1990 | Gregory et al. | |
| 2002/0011331 | A1* | 1/2002 | Lehman | F25J 5/002 62/903 |
| 2004/0173344 | A1 | 9/2004 | Averous et al. | |
| 2007/0012430 | A1 | 1/2007 | Duke et al. | |
| 2017/0051982 | A1* | 2/2017 | Takami | F28D 9/005 |
| 2017/0241686 | A1 | 8/2017 | Szostek et al. | |
| 2018/0112933 | A1 | 4/2018 | Takagi et al. | |

FOREIGN PATENT DOCUMENTS

| | | | |
|---|---|---|---|
| DE | 60219308 | T2 | 1/2008 |
| EP | 2998676 | A1 | 3/2016 |
| JP | S63123990 | A | 5/1988 |
| JP | H0198896 | A | 4/1989 |
| JP | H09196590 | A | 7/1997 |
| JP | 2016205802 | A | 12/2016 |
| JP | 2018009460 | A | 1/2018 |
| JP | 2018044680 | A | 3/2018 |

* cited by examiner

HEAT EXCHANGER

CROSS REFERENCE TO RELATED APPLICATIONS

The present application is a continuation application of International Patent Application No. PCT/JP2019/043484 filed on Nov. 6, 2019, which designated the U.S. and claims the benefit of priority from Japanese Patent Application No. 2018-212962 filed on Nov. 13, 2018 and Japanese Patent Application No. 2019-182356 filed on Oct. 2, 2019. The entire disclosures of all of the above applications are incorporated herein by reference.

TECHNICAL FIELD

The present disclosure relates to a heat exchanger.

BACKGROUND ART

A heat exchanger has plate members stacked with each other. The plate member is formed with a refrigerant passage through which refrigerant flows and a cooling water passage through which cooling water flows. In the heat exchanger, the refrigerant passage and the cooling water passage are alternately arranged in the stacking direction of the plate members.

SUMMARY

According to one aspect of the present disclosure, a heat exchanger includes a plurality of plate members stacked with each other to define a refrigerant passage and a fluid passage. A refrigerant flowing through the refrigerant passage and a fluid flowing through the fluid passage exchange heat with each other. The heat exchanger includes an inner fin arranged in the refrigerant passage. The inner fin has a plurality of side wall portions formed to extend in a predetermined direction and arranged in parallel with each other. A gap formed between the side wall portions facing each other is a passage portion through which the refrigerant flows. Each of the side wall portions has a plurality of openings arranged in the predetermined direction. A part of the side wall portion located between the openings adjacent to each other has an inclined surface inclined with respect to the predetermined direction.

DESCRIPTION OF EMBODIMENT

Figure 1:
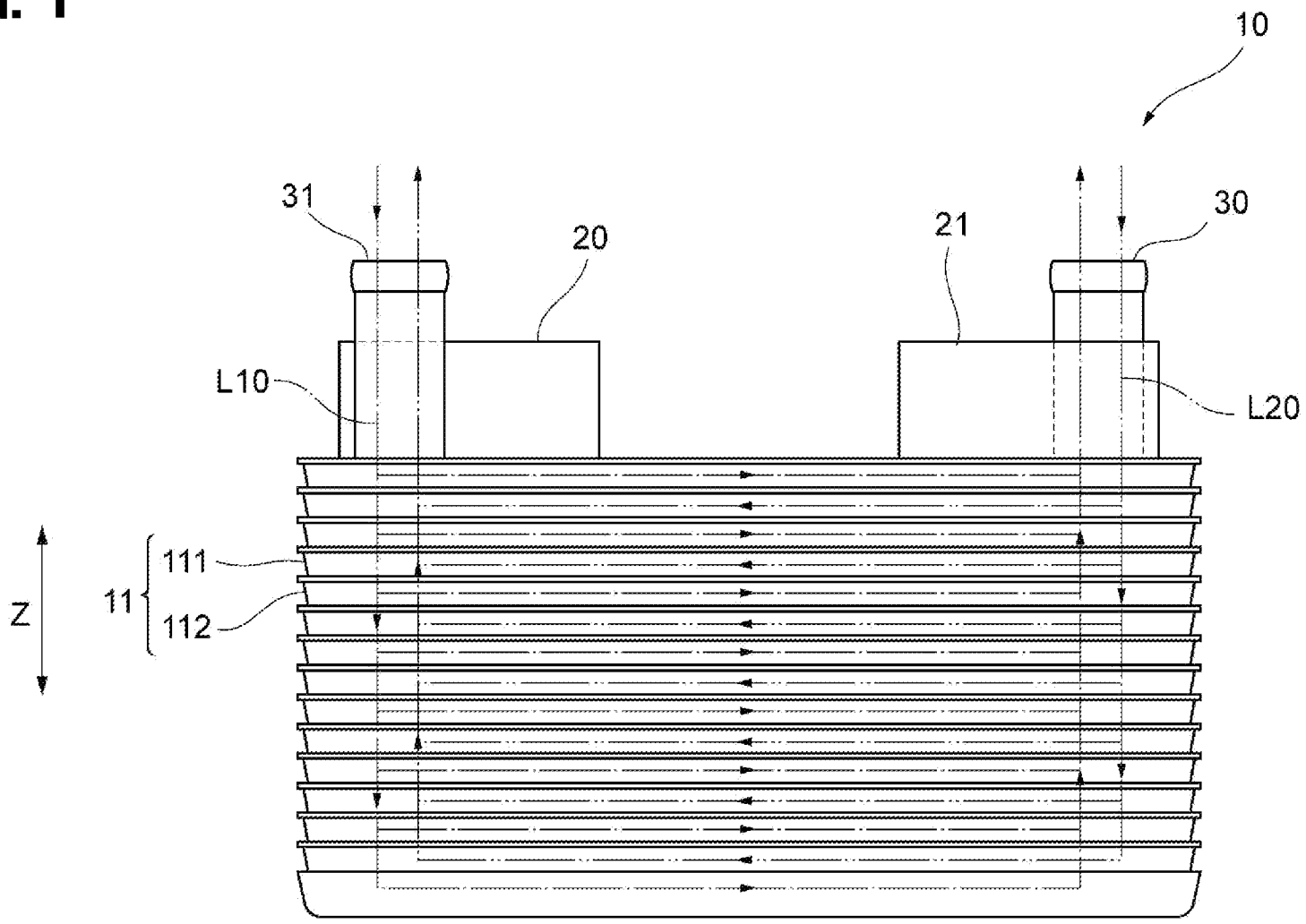
FIG. 1 is a front view showing a front structure of a heat exchanger according to a first embodiment.

To begin with, examples of relevant techniques will be described.

A heat exchanger has plate members are stacked with each other. The plate member is formed with a refrigerant passage through which refrigerant flows and a cooling water passage through which cooling water flows. In the heat exchanger, the refrigerant passage and the cooling water passage are alternately arranged in the stacking direction of the plate members. In the heat exchanger, heat is exchanged between the refrigerant flowing through the refrigerant passage and the cooling water flowing through the cooling water passage.

In the heat exchanger, an inner fin is arranged in the refrigerant passage. The inner fin has plate-shaped side walls arranged parallel to each other. A linear refrigerant passage is formed between the side walls facing each other. The side wall includes a first portion having an opening for communicating adjacent refrigerant passages and a second portion having no opening. The first portion and the second portion are arranged alternately along the extending direction of the refrigerant passage. A louver portion is formed on the inner peripheral portion of the opening. The louver portion is a plate-shaped portion protruding into the refrigerant passage. The louver portion is arranged parallel to the extending direction of the refrigerant passage.

In the heat exchanger, the refrigerant alternately repeats colliding with the louver portion in the first portion and flowing linearly along the second portion. Therefore, the pressure of the refrigerant becomes high in the first portion and low in the second portion. Such fluctuations in the pressure of the refrigerant make it possible to improve the distributability of the refrigerant in the refrigerant passage.

In the heat exchanger, the flow of refrigerant changes in each of the first portion and the second portion due to various factors such as the flow velocity of the refrigerant, the passage, and the physical properties. The pressure difference of the refrigerant generated in the first portion and the second portion changes due to the factors. That is, it may not be possible to improve the distributability of the refrigerant in the refrigerant passage in some cases due to the change in pressure difference of the refrigerant in each of the first portion and the second portion depending on the factors. In the conventional heat exchanger, there is room for improvement in the distributability of the refrigerant.

The present disclosure provides a heat exchanger capable of more accurately increasing the distributability of refrigerant.

According to one aspect of the present disclosure, a heat exchanger includes a plurality of plate members stacked with each other to define a refrigerant passage and a fluid passage. A refrigerant flowing through the refrigerant passage and a fluid flowing through the fluid passage exchange heat with each other. The heat exchanger includes an inner fin arranged in the refrigerant passage. The inner fin has a plurality of side wall portions formed to extend in a predetermined direction and arranged in parallel with each other. A gap formed between the side wall portions facing each other is a passage portion through which the refrigerant flows. Each of the side wall portions has a plurality of openings arranged in the predetermined direction. A part of the side wall portion located between the openings adjacent to each other has an inclined surface inclined with respect to the predetermined direction.

Accordingly, the refrigerant flowing in the passage portion flows along the inclined surface, so that the flow direction of the refrigerant can be changed in a direction inclined with respect to the predetermined direction. As a result, the flow direction of the refrigerant changes in the direction intersecting the predetermined direction, so that a gas-phase refrigerant, for example, can flow from a path where the pressure loss is high to a path where the pressure loss is low in the refrigerant passage. Therefore, the distributability of the liquid-phase refrigerant in the refrigerant passage can be improved.

Hereinafter, embodiments will be described with reference to the drawings. To facilitate understanding, identical constituent elements are designated with identical symbols in the drawings where possible with the duplicate description omitted.

First Embodiment

A heat exchanger 10 according to a first embodiment shown in FIG. 1 will be described. The heat exchanger 10 is used, for example, in a battery cooling chiller that exchanges heat between an automobile refrigeration cycle and a cooling water circuit for cooling a battery. Specifically, the cooling water such as LLC exchanges heat with a refrigerant in the heat exchanger 10. The cooling water is used as a fluid for exchanging heat with the refrigerant. The heat exchanger 10 is made of a metal material such as an aluminum alloy.

The heat exchanger 10 includes plural plate members 11 stacked in the Z direction. The plate members 11 are joined to each other by brazing or the like. Hereinafter, the Z direction is also referred to as "plate stacking direction Z". A gap is formed between the plate members 11 adjacent to each other. The gap defines a refrigerant passage through which the refrigerant flows or a cooling water passage through which the cooling water flows. In this embodiment, the cooling water passage corresponds to the fluid passage. In the following, the plate members 11 having the refrigerant passage will be referred to as a refrigerant plate member 111, and the plate member 11 having the cooling water passage will be referred to as a cooling water plate member 112. The refrigerant plate member 111 and the cooling water plate member 112 are alternately arranged in the plate stacking direction Z.

Figure 2:
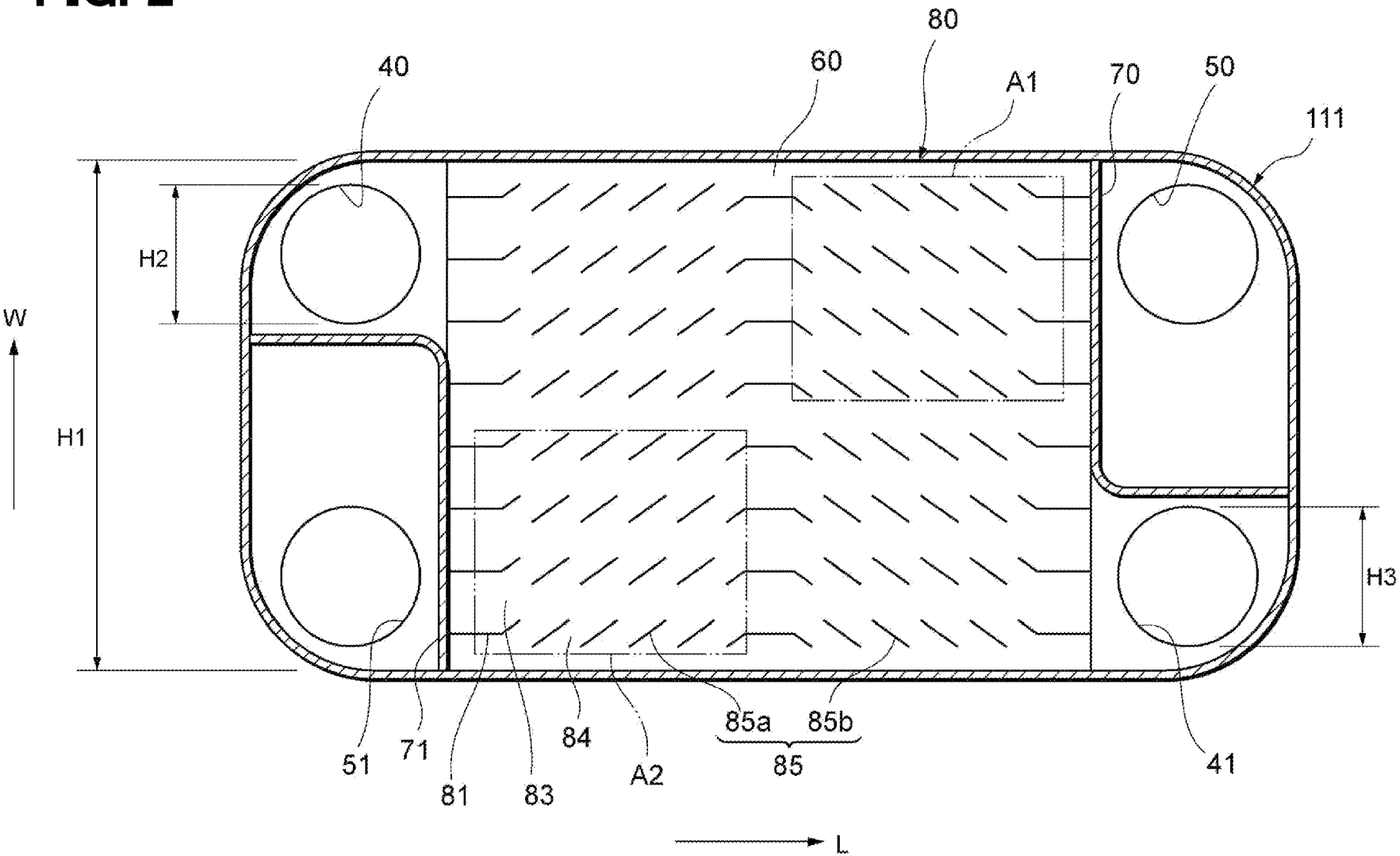
FIG. 2 is a cross-sectional view showing a refrigerant plate member of the first embodiment.

As shown in FIG. 2, the refrigerant plate member 111 has a substantially rectangular cup shape in the cross-section orthogonal to the plate stacking direction Z. The refrigerant passage 60 is formed by the internal space of the refrigerant plate member 111.

A refrigerant inflow port 40 and a refrigerant discharge port 41 are formed at two diagonal corners of the refrigerant plate member 111, respectively. Therefore, the inflow port 40 is formed at one end portion of the refrigerant passage 60, and the discharge port 41 is formed at the other end portion of the refrigerant passage 60. The inflow port 40 introduces the refrigerant into the refrigerant passage 60. The discharge port 41 discharges the refrigerant that has flowed through the refrigerant passage 60. In the refrigerant plate member 111, the refrigerant flows from the inflow port 40 toward the discharge port 41. That is, the refrigerant flows in the direction indicated by the arrow L in FIG. 2. Hereinafter, for convenience, the direction indicated by the arrow L is also referred to as "mainstream direction L of the refrigerant". In the present embodiment, the mainstream direction L of the refrigerant corresponds to a predetermined direction. Further, a direction orthogonal to the direction indicated by the arrow L is referred to as "width direction W". The width H2 of the inflow port 40 is shorter than the width H1 of the refrigerant passage 60 in the width direction W. The width H3 of the discharge port 41 in the width direction W is shorter than the width H1 of the refrigerant passage 60 in the width direction W.

Communication holes 50 and 51 for the cooling water are formed at the other two diagonal corners of the refrigerant plate member 111, respectively. The communication holes 50 and 51 make the cooling water passages of the cooling water plate members 112, 112 adjacent to each other through the refrigerant plate member 111 to communicate with each other. Partition walls 70 and 71 are provided in the refrigerant plate member 111, for partitioning the refrigerant passage 60 and the communication holes 50 and 51. The partition walls 70 and 71 suppress the refrigerant flowing through the refrigerant passage 60 from flowing into the communication holes 50 and 51, and suppresses the cooling water flowing through the communication holes 50 and 51 from flowing into the refrigerant passage 60.

Figure 3:
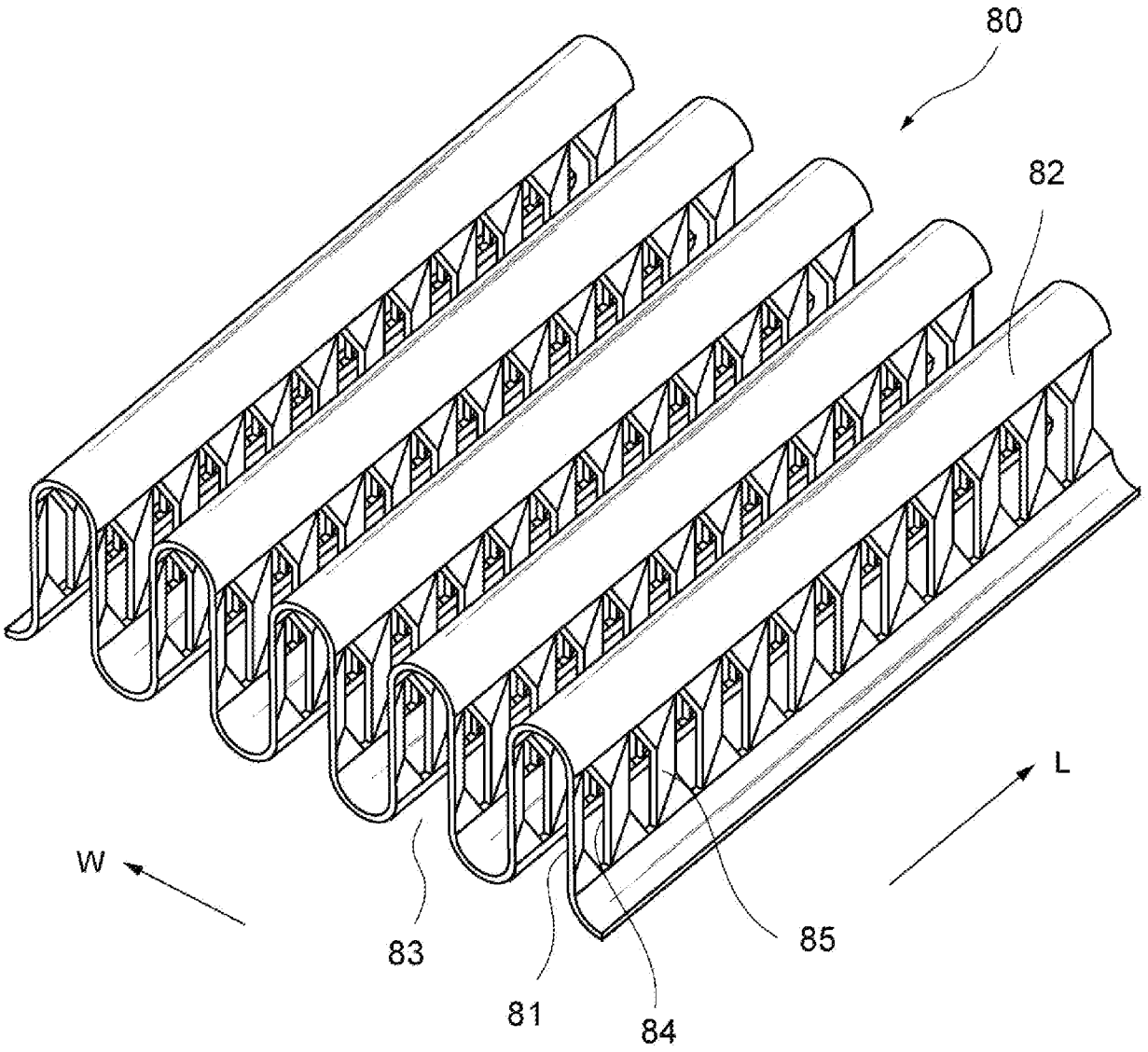
FIG. 3 is a perspective view showing an inner fin of the first embodiment.

An inner fin 80 is arranged in the refrigerant passage 60 of the refrigerant plate member 111. As shown in FIG. 3, the inner fin 80 is composed of so-called corrugated fin formed by bending a flat metal member in a wavy shape in the width direction W. The inner fin 80 is provided to increase the heat transfer area of the refrigerant. Note that FIG. 2 schematically shows the structure of the inner fin 80.

Figure 4:
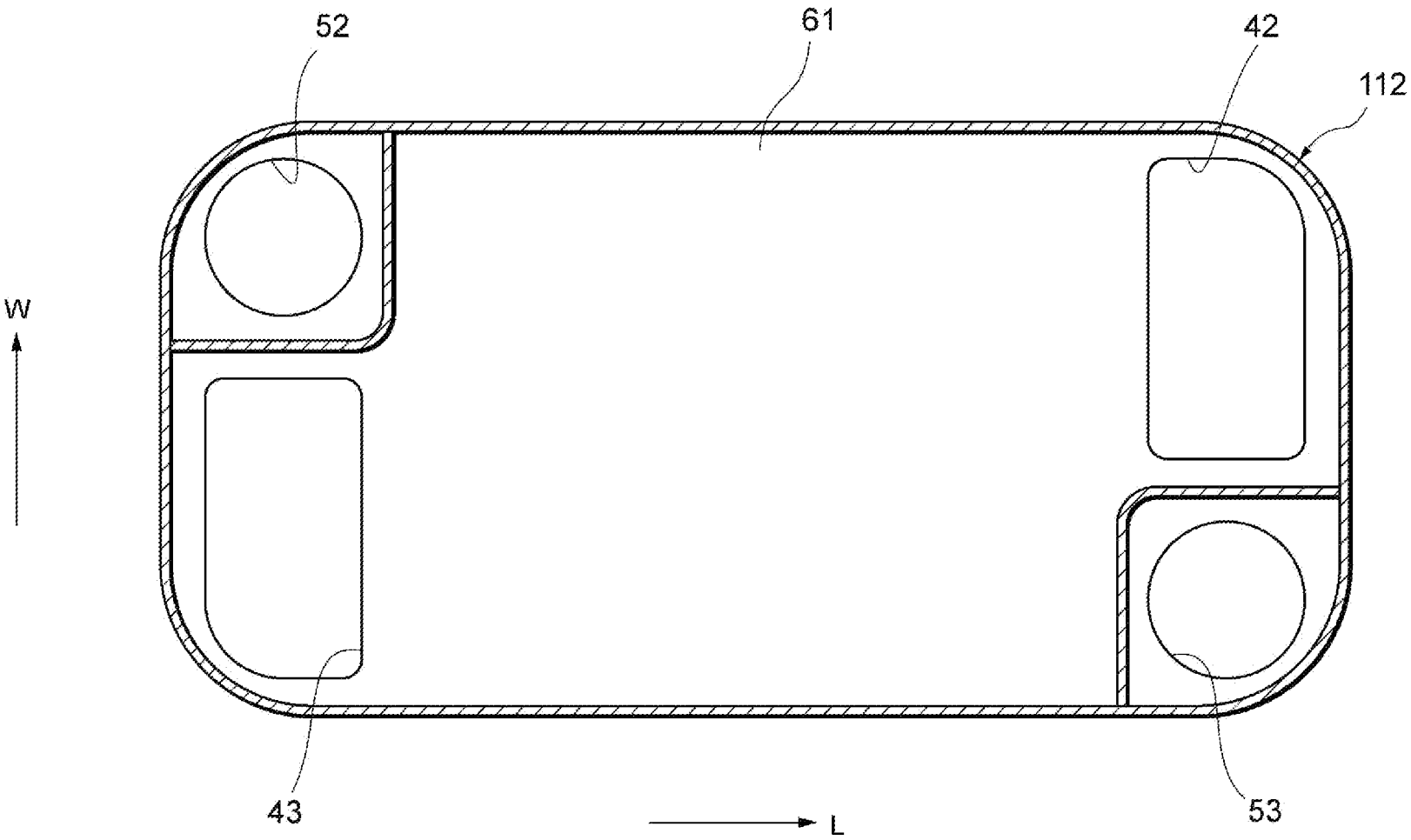
FIG. 4 is a cross-sectional view showing a cooling water plate member of the first embodiment.

As shown in FIG. 4, the cooling water plate member 112 has substantially the same structure as the refrigerant plate member 111, while the internal space of the cooling water plate member 112 forms the cooling water passage 61. The cooling water plate member 112 has communication holes 52 and 53 at positions corresponding to the inflow port 40 and the discharge port 41 defined in the refrigerant plate member 111, respectively. The communication hole 52 is for communicating the inflow ports 40 of the refrigerant plate members 111, 111 adjacent to each other through the cooling water plate member 112. The communication hole 53 is for communicating the discharge ports 41 of the refrigerant plate members 111, 111 adjacent to each other through the cooling water plate member 112.

The cooling water plate member 112 has the inflow port 42 and the discharge port 43 at positions corresponding to the communication holes 50 and 51 defined in the refrigerant plate member 111, respectively. The inflow ports 42, 42 of the cooling water plate members 112, 112 adjacent to each other with the refrigerant plate member 111 interposed therebetween are communicated with each other through the communication hole 50 of the refrigerant plate member 111. Similarly, the discharge ports 43, 43 of the cooling water plate members 112, 112 adjacent to each other with the refrigerant plate member 111 interposed therebetween are communicated with each other through the communication hole 51 of the refrigerant plate member 111.

While the cooling water plate member 112 not provided with the inner fin is shown in FIG. 4, the inner fin may be arranged in the cooling water passage 61 of the cooling water plate member 112 as in the refrigerant plate member 111.

As shown in FIG. 1, the plate member 11 arranged at the uppermost position is provided with a refrigerant inflow pipe 20, a refrigerant discharge pipe 21, a cooling water inflow pipe 30, and a cooling water discharge pipe 31. The inner diameter of the pipe 20, 21, 30, 31 is shorter than the width H1 of the refrigerant passage 60 shown in FIG. 2.

Figure 5:
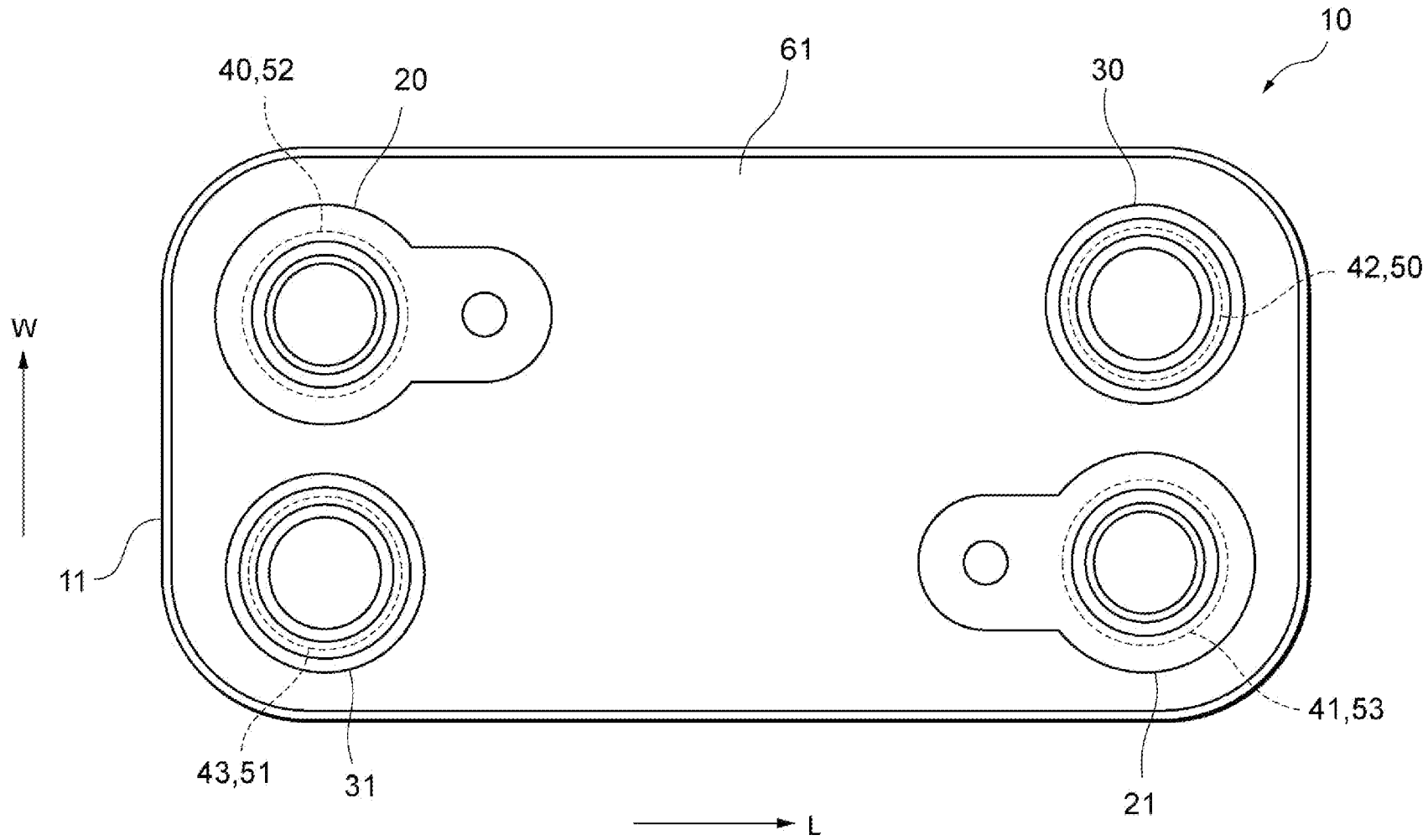
FIG. 5 is a plan view showing the heat exchanger of the first embodiment.

As shown in FIG. 5, the refrigerant inflow pipe 20 is provided at a position corresponding to the inflow port 40 of the refrigerant plate member 111 and the communication hole 52 of the cooling water plate member 112. The refrigerant discharge pipe 21 is provided at a position corresponding to the discharge port 41 of the refrigerant plate member 111 and the communication hole 53 of the cooling water plate member 112. The cooling water inflow pipe 30 is provided at a position corresponding to the inflow port 42 of the cooling water plate member 112 and the communication hole 50 of the refrigerant plate member 111. The cooling water discharge pipe 31 is provided at a position corresponding to the discharge port 43 of the cooling water plate member 112 and the communication hole 51 of the refrigerant plate member 111.

The refrigerant is introduced from the refrigerant inflow pipe 20 into the heat exchanger 10. The refrigerant is distributed to the refrigerant passage 60 of the refrigerant plate member 111 through the inflow port 40 of the refrigerant plate member 111 and the communication hole 52 of the cooling water plate member 112. As described above, the inflow port 40 of the refrigerant plate member 111 and the communication hole 52 of the cooling water plate member 112 serve as an inlet-side refrigerant tank for distributing the refrigerant to the refrigerant passage 60 of the refrigerant plate member 111. The refrigerant that has flowed through the refrigerant passage 60 of the refrigerant plate member 111 is collected at the discharge port 41 of the refrigerant plate member 111 and the communication hole 53 of the cooling water plate member 112, and is discharged from the refrigerant discharge pipe 21. As described above, the discharge port 41 of the refrigerant plate member 111 and the communication hole 53 of the cooling water plate member 112 serve as an outlet-side refrigerant tank for collecting the refrigerant flowing through the refrigerant passage 60 of the refrigerant plate member 111.

The cooling water is introduced from the cooling water inflow pipe 30 into the heat exchanger 10. The cooling water is distributed to the cooling water passage 61 of the cooling water plate member 112 through the inflow port 42 of the cooling water plate member 112 and the communication hole 50 of the refrigerant plate member 111. Further, the cooling water flowing through the cooling water passage 61 of the cooling water plate member 112 passes through the discharge port 43 of the cooling water plate member 112 and the communication hole 51 of the refrigerant plate member 111, and is discharged from the cooling water discharge pipe 31.

In the heat exchanger 10, as shown in FIG. 1, the refrigerant flows in the single chain line L10, and the cooling water flows in the double chain line L20. In the heat exchanger 10, heat is exchanged between the refrigerant flowing through the refrigerant passage 60 of the refrigerant plate member 111 and the cooling water flowing through the cooling water passage 61 of the cooling water plate member 112. When flowing into the refrigerant passage 60 from the inflow port 40 of the refrigerant plate member 111, the refrigerant is two-phase refrigerant in which a liquid-phase refrigerant and a gas-phase refrigerant are mixed. The refrigerant flowing through the refrigerant passage 60 absorbs heat of the cooling water by exchanging heat with the cooling water flowing through the cooling water passage 61. Therefore, in the refrigerant passage 60, the amount of gas-phase refrigerant increases from the inflow port 40 toward the discharge port 41.

Next, the specific structure of the inner fin 80 arranged in the refrigerant passage 60 will be described.

As shown in FIG. 3, the inner fin 80 is formed in a wavy shape. The inner fin 80 has plural side wall portions 81 arranged parallel to each other, and a connecting portion 82 that connects upper end portions or lower end portions of the side wall portions 81, 81 adjacent to each other.

The side wall portion 81 is formed so as to extend in the mainstream direction L of the refrigerant. The gap formed between the side wall portions 81 and 81 facing each other is the passage portion 83 through which the refrigerant flows.

The side wall portion 81 has plural openings 84 arranged in the mainstream direction L of the refrigerant. The side wall portion 81 has an inclined surface 85 inclined with respect to the mainstream direction L of the refrigerant at a location between the openings 84, 84 adjacent to each other. The opening 84 and the inclined surface 85 are not formed in the connecting portion 82, but are formed only in the side wall portion 81.

As shown in FIG. 2, the inclined surface 85 has a first inclined surface 85*a* and a second inclined surface 85*b* having different inclination orientations from each other. Specifically, a part of the side wall portion 81 located between the inflow port 40 and the central portion in the mainstream direction L of the refrigerant has the first inclined surface 85*a* inclined so as to change the flow direction of the refrigerant in a direction away from the discharge port 41. A part of the side wall portion 81 located between the discharge port 41 and the central portion in the mainstream direction L of the refrigerant has the second inclined surface 85*b* inclined so as to change the flow direction of the refrigerant toward the discharge port 41.

Next, an operation example of the heat exchanger 10 of the present embodiment will be described.

As shown in FIG. 2, the inflow port 40 and the discharge port 41 are diagonally arranged in the refrigerant plate member 111. For example, when the inner fin 80 is not provided, the refrigerant that has flowed into the refrigerant passage 60 from the inflow port 40 easily flows in the shortest path toward the discharge port 41, since the pressure loss is the smallest. Therefore, the flow rate of the refrigerant flowing in the regions A1 and A2 shown by the double chain line in FIG. 2 becomes relatively small. In the region where the flow rate of refrigerant is low, the change from the two-phase refrigerant to the gas-phase refrigerant due to heat exchange with the cooling water is completed in the first half of the fluid path. The path length flowing as the gas-phase refrigerant becomes relatively long. The pressure loss becomes higher, when the refrigerant flows through the rest of the path, and the refrigerant becomes more difficult to flow. This causes deterioration of the distributability of the refrigerant in the refrigerant passage 60.

In this regard, in the heat exchanger 10 of the present embodiment, the refrigerant flowing into the refrigerant passage 60 from the inflow port 40 flows along the first inclined surface 85*a* when passing through the passage portion 83 of the inner fin 80. The flow direction of the refrigerant can be changed in the width direction W. More specifically, the gas-phase refrigerant passing through the regions A1 and A2 can be changed to flow in the direction toward the outside of the regions A1 and A2. As a result, the liquid-phase refrigerant can easily flow into the regions A1 and A2. That is, the gas-phase refrigerant can flow from the path having a high pressure loss to the path having a low pressure loss, so that the pressure loss difference between the paths can be reduced. It is possible to suppress the uneven distribution of the liquid-phase refrigerant. Therefore, the distributability of the liquid-phase refrigerant in the refrigerant passage 60 can be improved.

According to the heat exchanger 10 of the present embodiment, effects described in the following items (1) to (4) can be obtained.

(1) The inclined surface 85 formed on the inner fin 80 can change the flow direction of the refrigerant in the width direction W. The gas-phase refrigerant can flow from the path where the pressure loss is high to the path where the pressure loss is low in the refrigerant passage 60, by positively changing the flow direction of the refrigerant by the inclined surface 85 in this way. The difference in pressure loss can be reduced, and the distributability of the liquid-phase refrigerant in the refrigerant passage 60 can be improved.

As shown in FIG. 2, the width H2 of the inflow port 40 and the width H3 of the discharge port 41 are shorter than the width H1 of the refrigerant passage 60 as in the heat exchanger 10 of the present embodiment. When a structure in which the bias of the distribution of the refrigerant is predetermined is adopted, the flow of the refrigerant can be controlled by the inclined surface 85 such that the distribution can be made uniform. It is possible to improve the distributability of the refrigerant more accurately.

As shown in FIG. 2, when the flow rate distribution of the refrigerant exists in the width direction W in the refrigerant passage 60, the temperature distribution is also biased in the width direction W. Therefore, if the heat exchanger 10 of the present embodiment can reduce the bias of the flow rate distribution of the refrigerant, it is possible to reduce the bias of the temperature distribution as a result. Further, since it is possible to optimize the overall flow of the refrigerant regardless of the gas-phase or the liquid-phase, it is possible to reduce the pressure loss acting on the refrigerant when flowing through the inner fin 80.

(2) The opening 84 and the inclined surface 85 are formed by cutting and deforming the inner fin 80. Accordingly, the opening 84 and the inclined surface 85 can be formed in the inner fin 80 without reducing the heat transfer area of the inner fin 80, so that the heat transfer area can be maximized. Therefore, the heat exchange performance can be improved. Further, since the refrigerant flowing in the direction indicated by the arrow L in the passage portion 83 collides with the inclined surface 85, the effect of improving the local heat transfer coefficient is achieved by the front edge effect due to the collision. Further, according to such a method for manufacturing the inner fin 80, since no offcuts are generated, the manufacturability can be improved.

(3) When the refrigerant is in a two-phase state of gas-phase and liquid-phase, the liquid-phase refrigerant tends to flow so as to stick to the vicinity of the curved connecting portion 82 due to its surface tension. That is, the liquid-phase refrigerant tends to flow along the upper end portion and the lower end portion of the side wall portion 81 in the plate stacking direction Z. On the other hand, the gas-phase refrigerant tends to flow in the central portion of the side wall portion 81. In this regard, the opening 84 and the inclined surface 85 are formed only on the side wall portion 81 as in the heat exchanger 10 of the present embodiment. Therefore, the inclined surface 85 formed on the side wall portion 81 allows the flow of the gas-phase refrigerant to easily change the flow direction in the width direction W. As a result, the gas-phase refrigerant, which is the main cause of the pressure loss, easily passes through the opening 84, so that the balance of the pressure loss among the plural passage portions 83 can be made uniform. Therefore, a high effect can be expected in uniformizing the refrigerant distribution in the width direction W. Further, when the inner fin 80 is manufactured, the connecting portion 82 that requires bending and the side wall portion 81 that requires cutting can be processed separately from each other, so that the inner fin 80 can be easily manufactured. Therefore, the manufacturability of the inner fin 80 can be improved.

(4) A part of the side wall portion 81 between the inflow port 40 and the central portion in the mainstream direction L of the refrigerant has the first inclined surface 85*a* so as to change the flow direction of the refrigerant in a direction away from the discharge port 41. Further, a part of the side wall portion 81 between the discharge port 41 and the central portion in the mainstream direction L of the refrigerant has the second inclined surface 85*b* that is inclined so as to change the flow direction of the refrigerant toward the discharge port 41. Such a configuration is effective for improving the distributability of the refrigerant in the heat exchanger 10 in which the refrigerant inflow port 40 and the refrigerant discharge port 41 are arranged diagonally of the refrigerant plate member 111, as shown in FIG. 2.

Modifications

Next, a first modification of the heat exchanger 10 of the first embodiment will be described.

Figure 6:
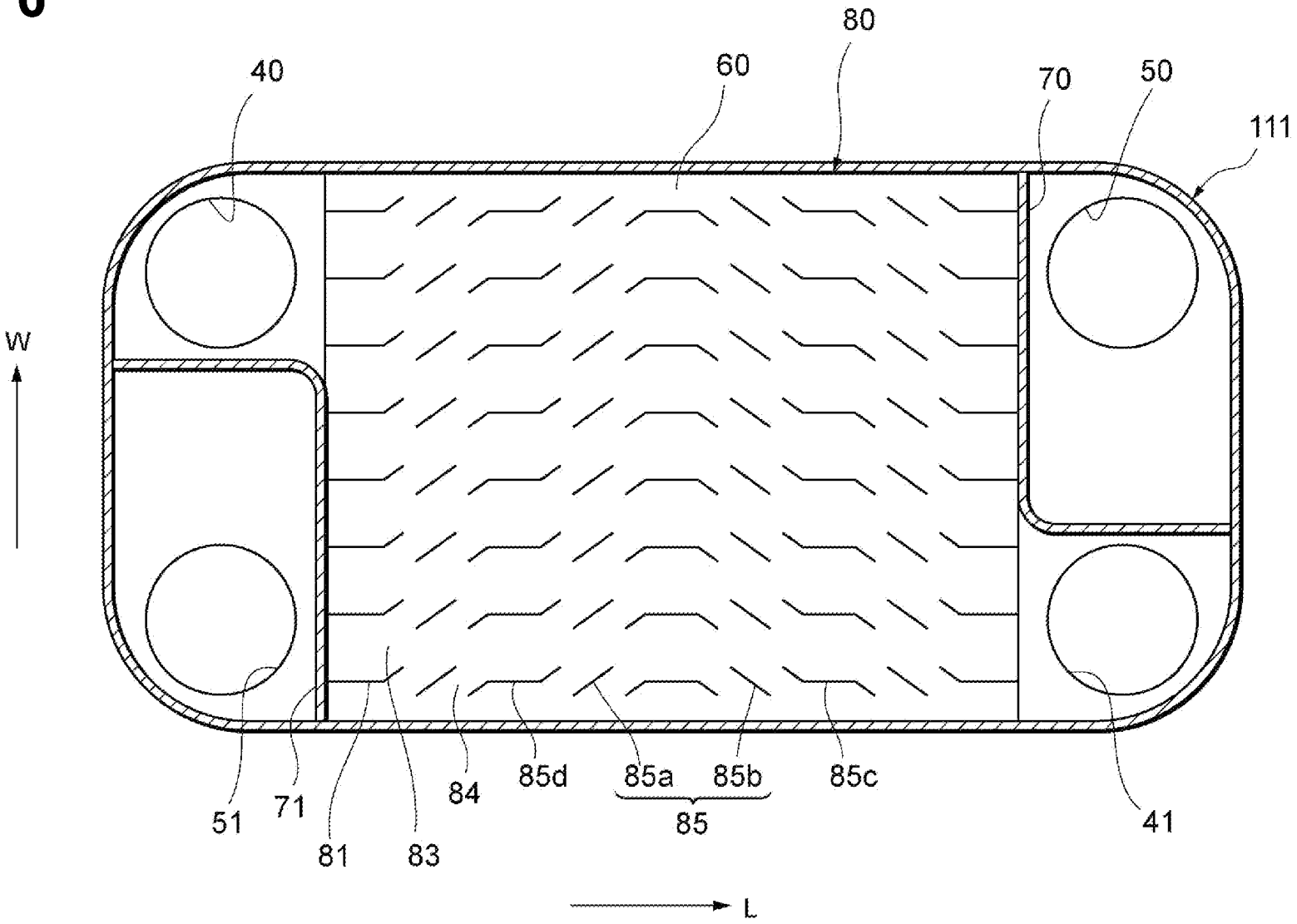
FIG. 6 is a cross-sectional view showing a refrigerant plate member of a modification of the first embodiment.

As shown in FIG. 6, in the heat exchanger 10 of this modification, a straight portion 85*d* parallel to the mainstream direction L of the refrigerant is formed in the middle of the area of the side wall portion 81 where the first inclined surface 85*a* is formed. Similarly, a straight portion 85*c* parallel to the mainstream direction L of the refrigerant is formed in the middle of the area of the side wall portion 81 where the second inclined surface 85*b* is formed. The same or similar operation and effect as the heat exchanger 10 of the first embodiment can be obtained in this modification.

Second Embodiment

Next, a second embodiment of the heat exchanger 10 will be described. Hereinafter, the differences from the heat exchanger 10 of the first embodiment will be mainly described.

Depending on the physical properties such as the surface tension of the refrigerant and the degree of opening of the opening 84, even when the first inclined surface 85*a* and the second inclined surface 85*b* are formed as in the inner fin 80 of the first embodiment, it may not be possible to improve the distributability of the refrigerant. The shape, number, and the like of the inclined surfaces 85 formed on the inner fin 80 can be changed as appropriate. Hereinafter, specific modifications thereof will be described with reference to FIGS. 7 to 11.

Figure 7:
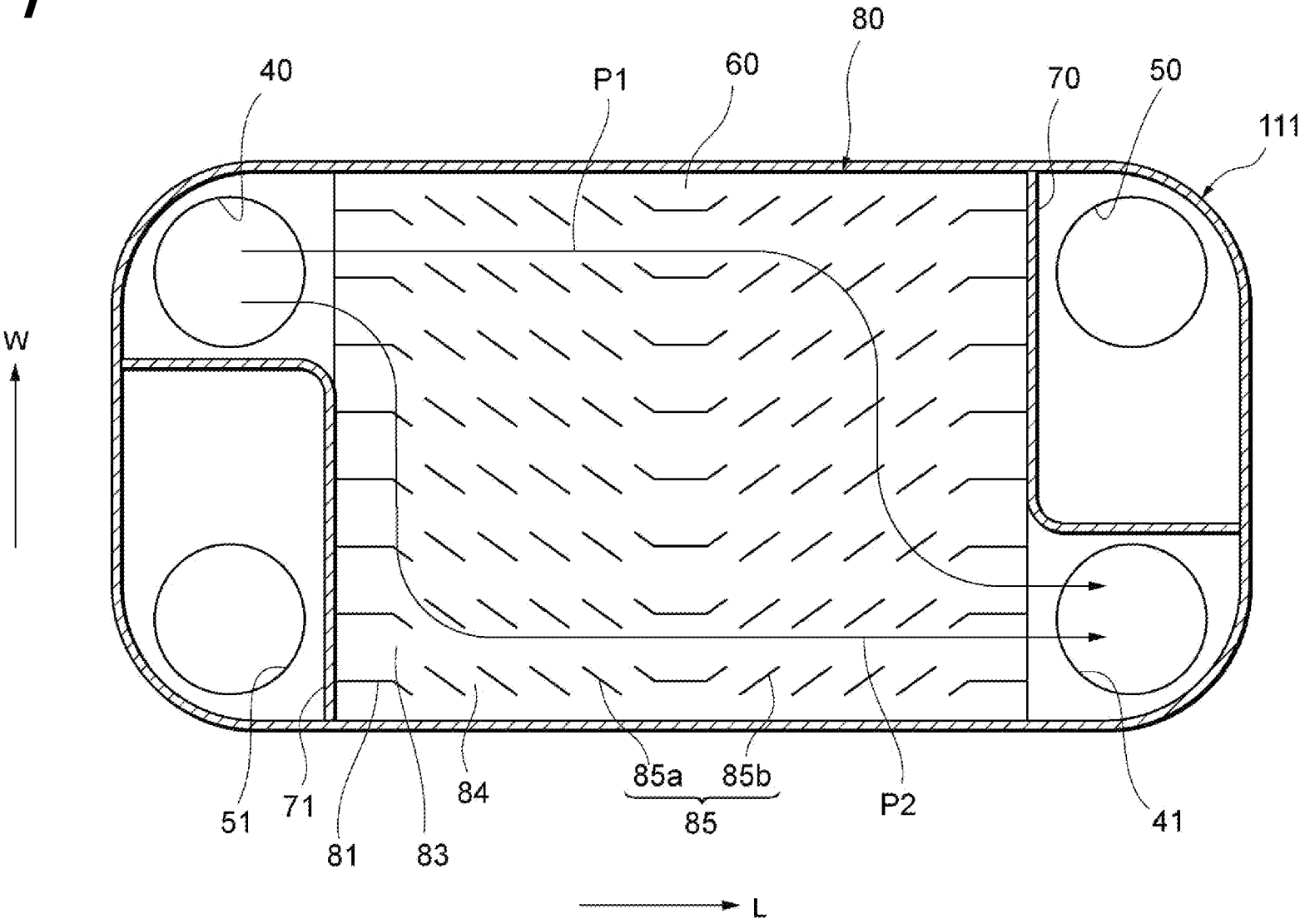
FIG. 7 is a cross-sectional view showing a refrigerant plate member of a second embodiment.

In the inner fin 80 shown in FIG. 7, a part of the side wall portion 81 located between the central portion and the inflow port 40 in the mainstream direction L of the refrigerant has the second inclined surface 85*b* inclined so as to change the flow direction of the refrigerant toward the discharge port 41. A part of the side wall portion 81 located between the central portion and the discharge port 41 in the mainstream direction L of the refrigerant has the first inclined surface 85*a* that is inclined so as to change the flow direction of the refrigerant in a direction away from the discharge port 41.

Figure 8:
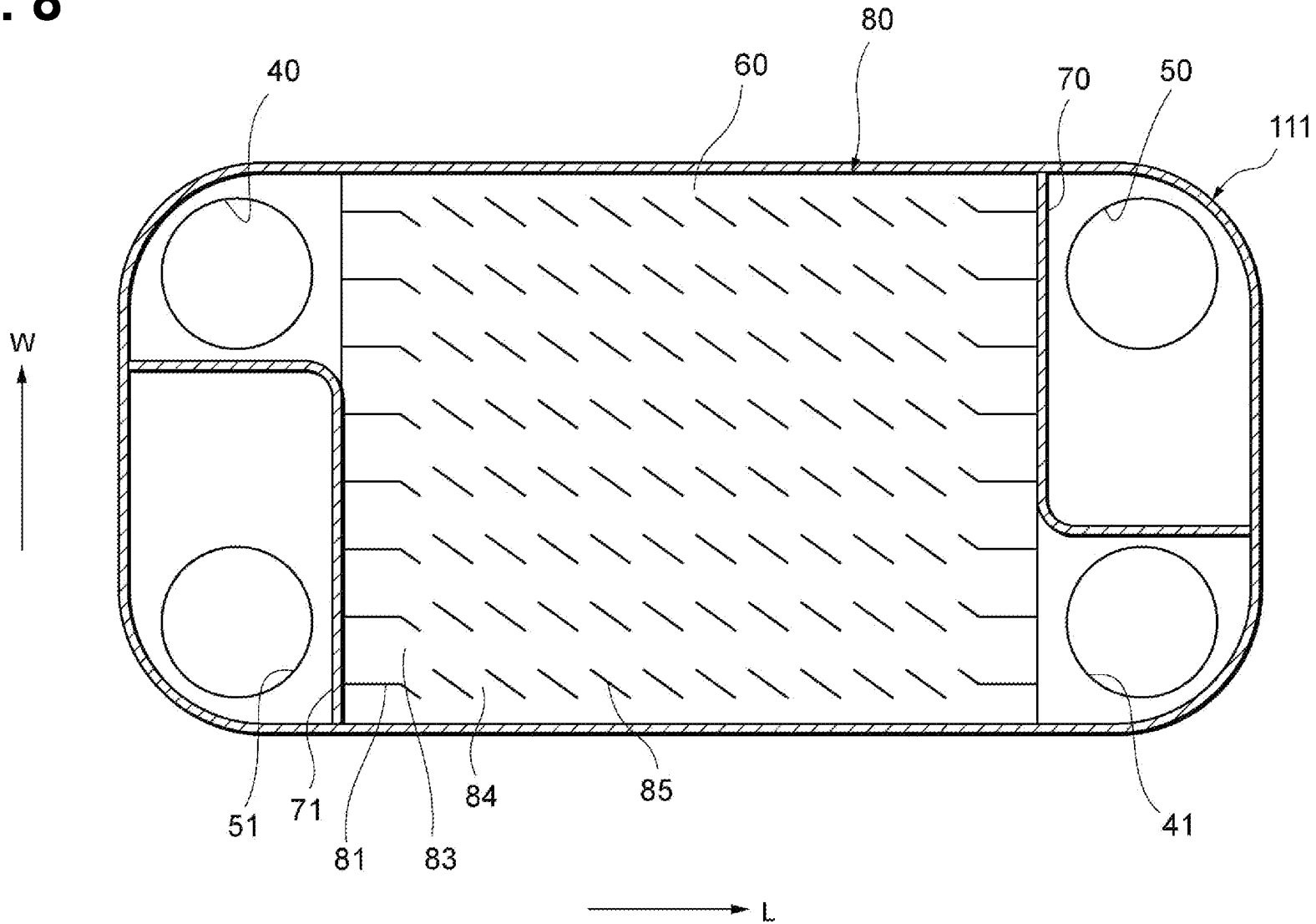
FIG. 8 is a cross-sectional view showing a refrigerant plate member of a modification of the second embodiment.

In the inner fin 80 shown in FIG. 8, only the inclined surface 85 that is inclined so as to change the flow direction of the refrigerant toward the discharge port 41 is formed on the side wall portion 81.

Figure 9:
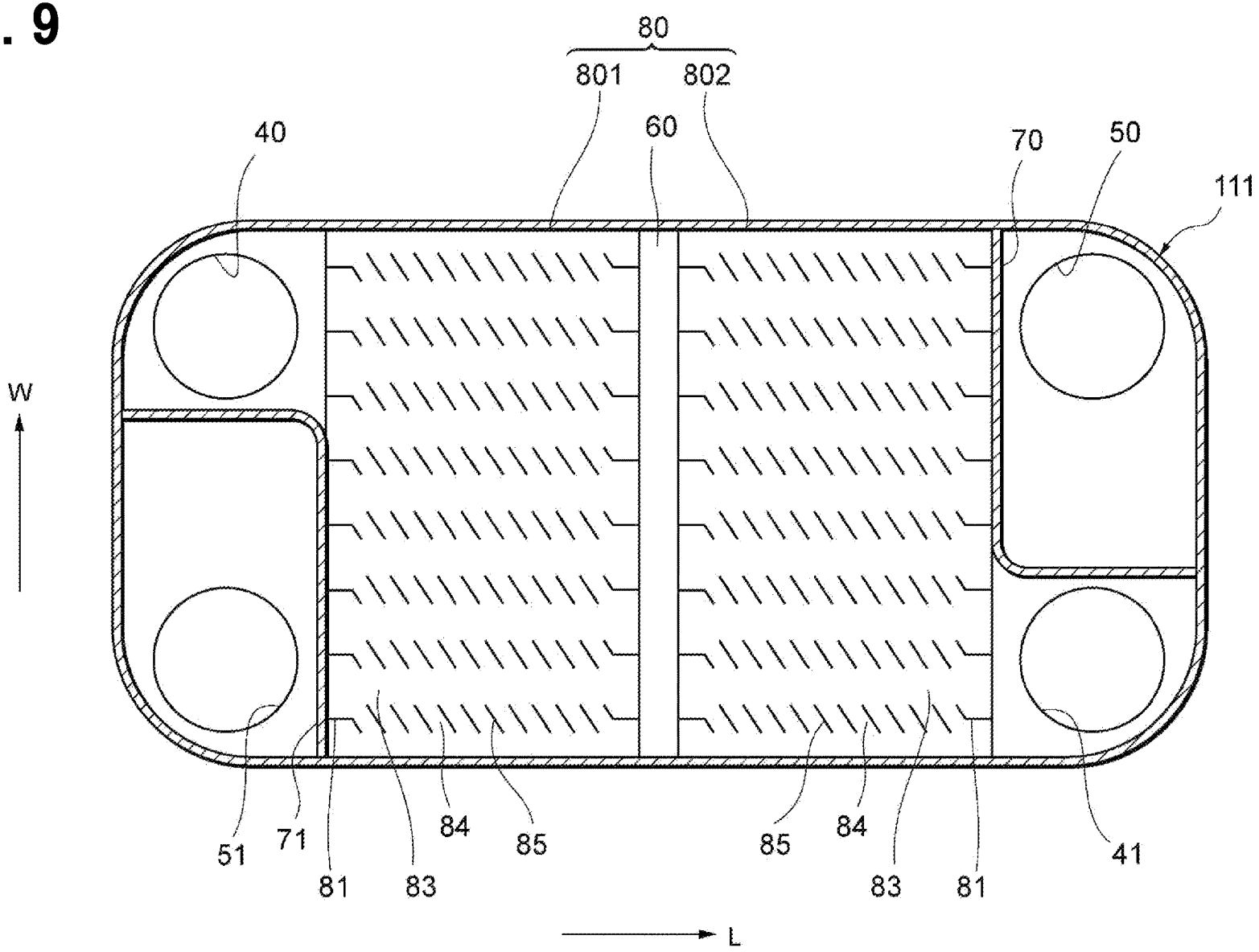
FIG. 9 is a cross-sectional view showing a refrigerant plate member according to another modification of the second embodiment.

The inner fin 80 shown in FIG. 9 has a first fin piece 801 and a second fin piece 802. The side wall portion 81 of the first fin piece 801 has only the inclined surface 85 that is inclined so as to change the flow direction of the refrigerant toward the discharge port 41. Similarly, the second fin piece 802 has only the inclined surface 85 that is inclined so as to change the flow direction of the refrigerant toward the discharge port 41. Accordingly, after the inner fin 80 of the first embodiment is manufactured, the first fin piece 801 and the second fin piece 802 can be formed only by cutting the inner fin 80 at the central portion. Therefore, the inner fin 80 can be formed easily.

Figure 10:
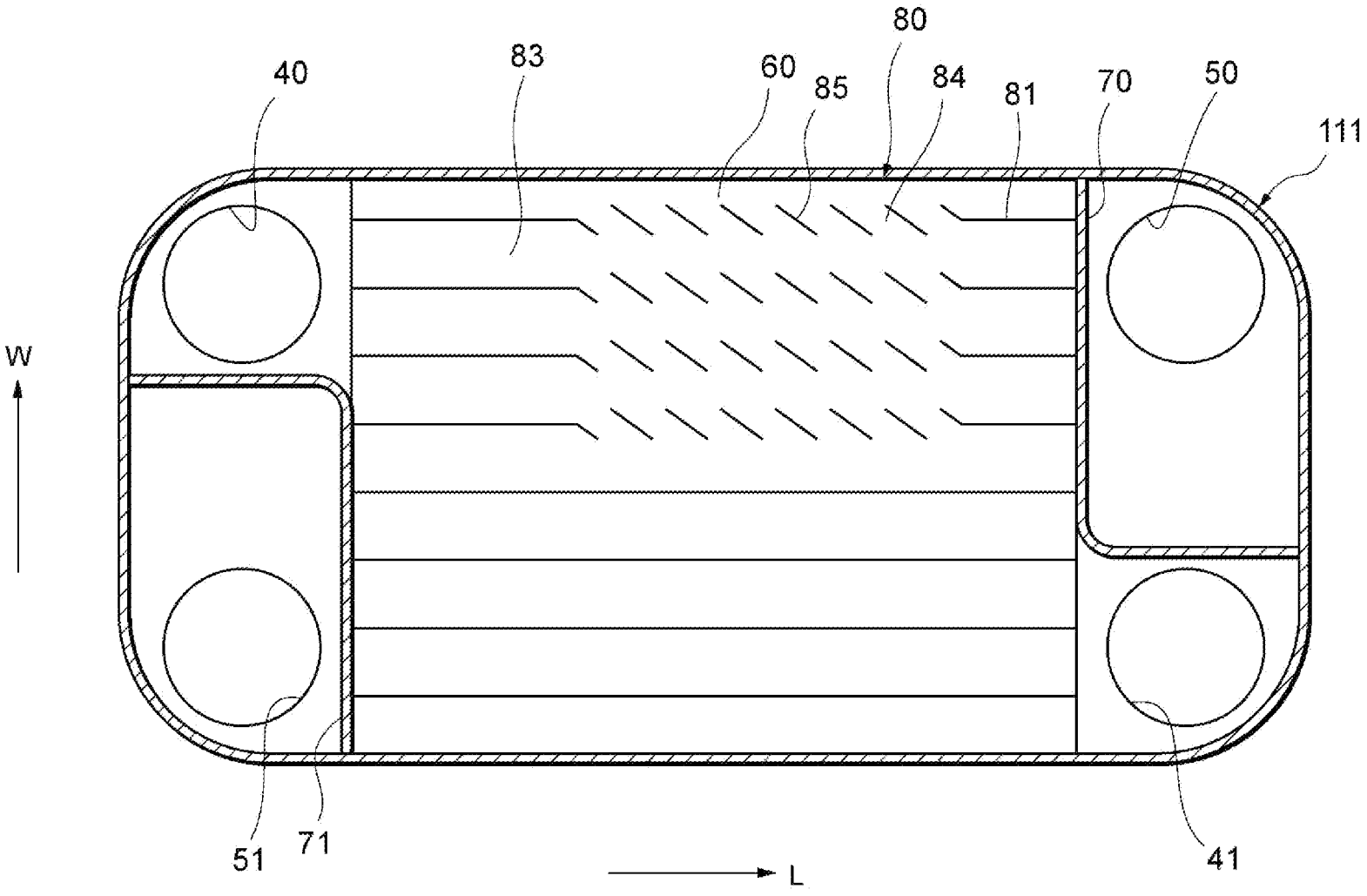
FIG. 10 is a cross-sectional view showing a refrigerant plate member according to another modification of the second embodiment.

In the inner fin 80 shown in FIG. 10, the opening 84 and the inclined surface 85 are formed only in a part of the plural side wall portions 81 arranged side by side in the width direction W. It is possible to change a part of the flow of the refrigerant flowing through the refrigerant passage 60 by using the inner fin 80.

Figure 11:
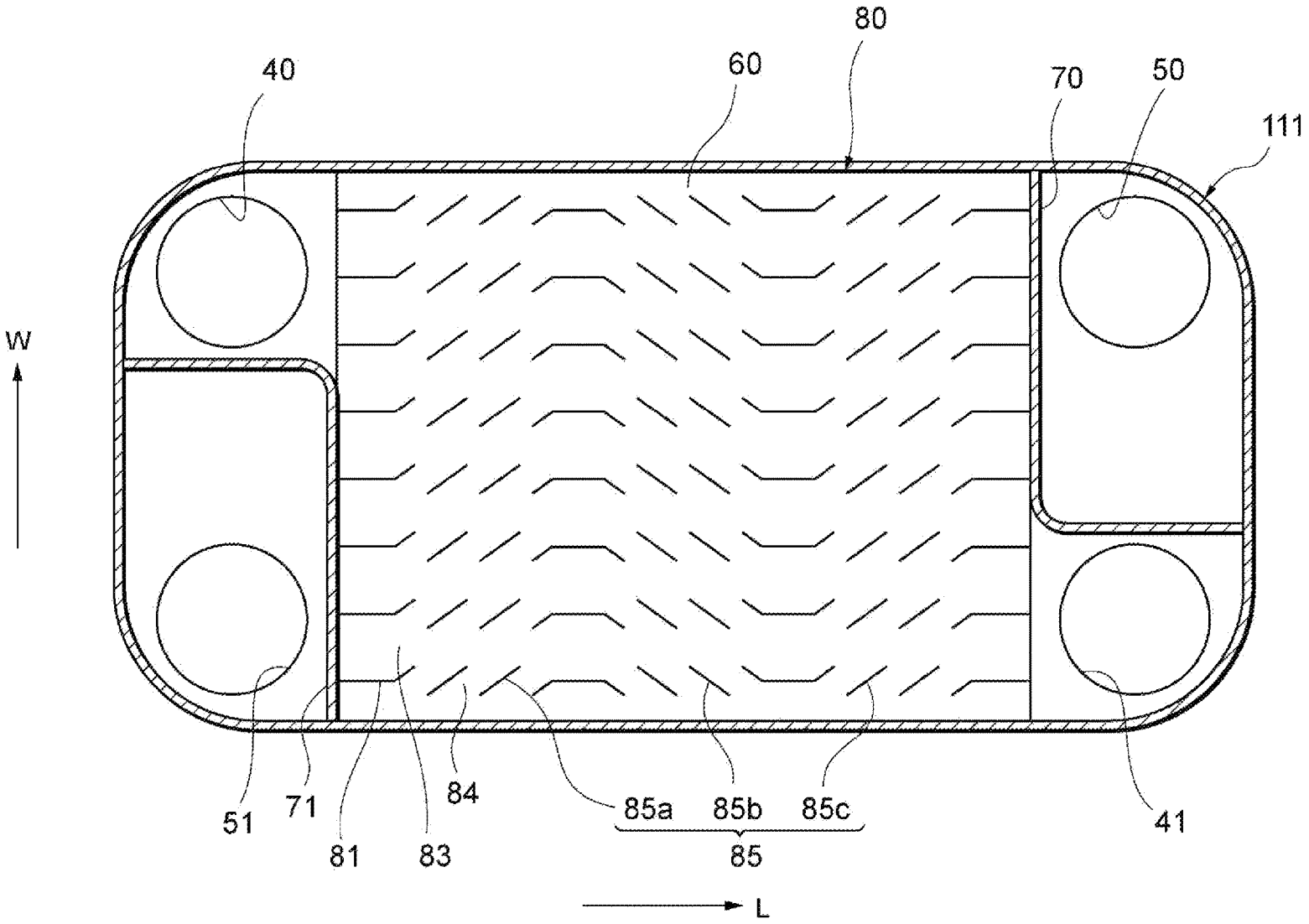
FIG. 11 is a cross-sectional view showing a refrigerant plate member according to another modification of the second embodiment.

The inner fin 80 shown in FIG. 11 has three inclined surfaces 85*a* to 85*c* alternately formed on the side wall portion 81. Four or more inclined surfaces may be formed alternately on the side wall portion.

Third Embodiment

Next, a third embodiment of the heat exchanger 10 will be described. Hereinafter, the differences from the heat exchanger 10 of the first embodiment will be mainly described.

Figure 12:
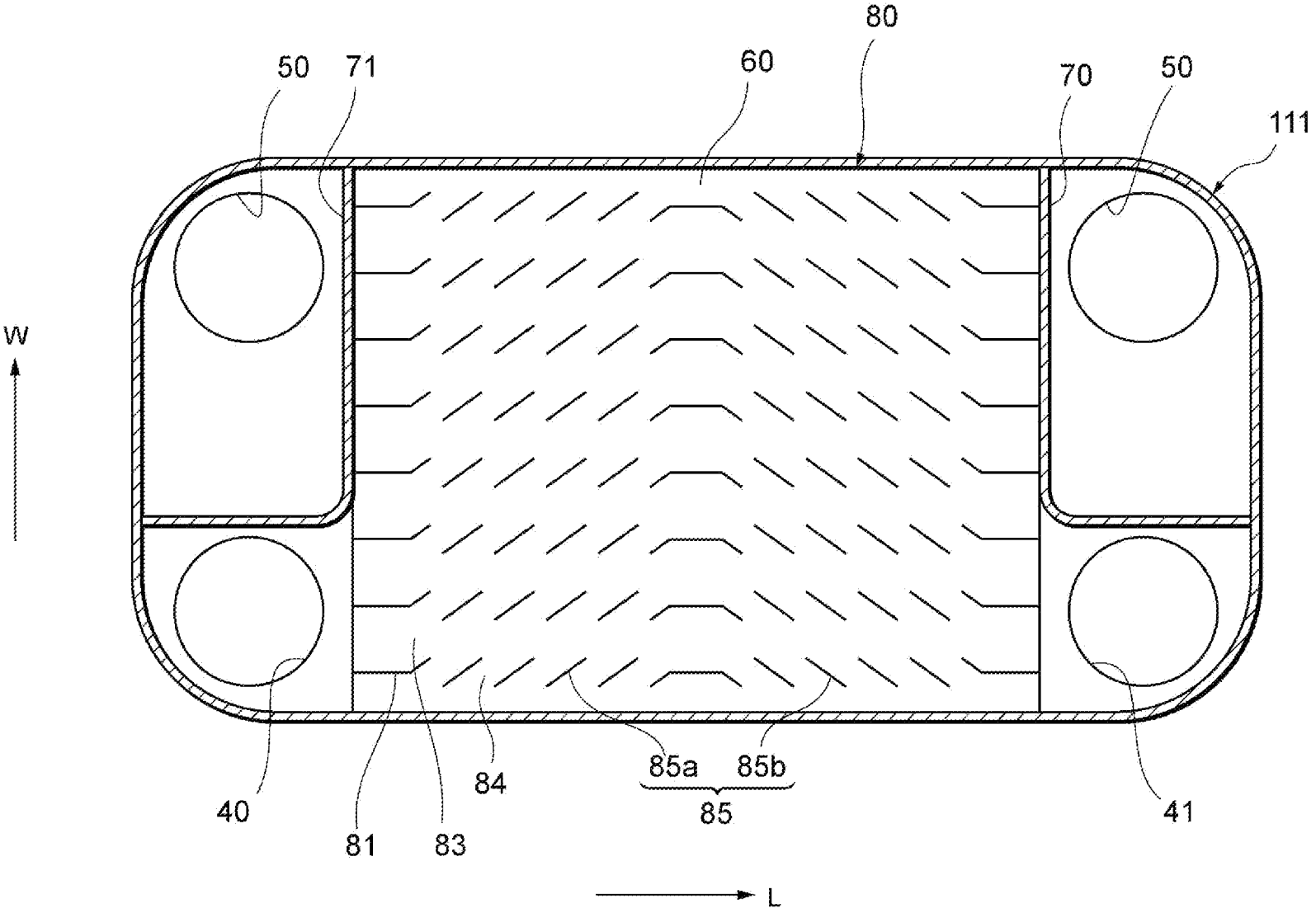
FIG. 12 is a cross-sectional view showing a refrigerant plate member of a third embodiment.

As shown in FIG. 12, the refrigerant inflow port 40 and the refrigerant discharge port 41 are formed in two corners, at one end in the width direction W, along one side of the refrigerant plate member 111. Further, the communication holes 50 and 51 for the cooling water are formed in two corners, at the other end in the width direction W, along the other side of the refrigerant plate member 111.

Since the cooling water plate member 112 has a structure similar to that of the refrigerant plate member 111, detailed description thereof will be omitted.

As shown in FIG. 12, the inner fin 80 is arranged in the refrigerant passage 60 of the refrigerant plate member 111. The structure of the inner fin 80 of the present embodiment is the same as the structure of the inner fin 80 of the first embodiment.

According to the heat exchanger 10 having such a refrigerant plate member 111, the flow direction of the refrigerant flowing through the refrigerant passage 60 can be changed in the width direction W by using the inner fin 80 as shown in FIG. 12. Therefore, the distributability of the refrigerant can be improved.

Fourth Embodiment

Next, a fourth embodiment of the heat exchanger 10 will be described. Hereinafter, the differences from the heat exchanger 10 of the first embodiment will be mainly described.

Figure 13:
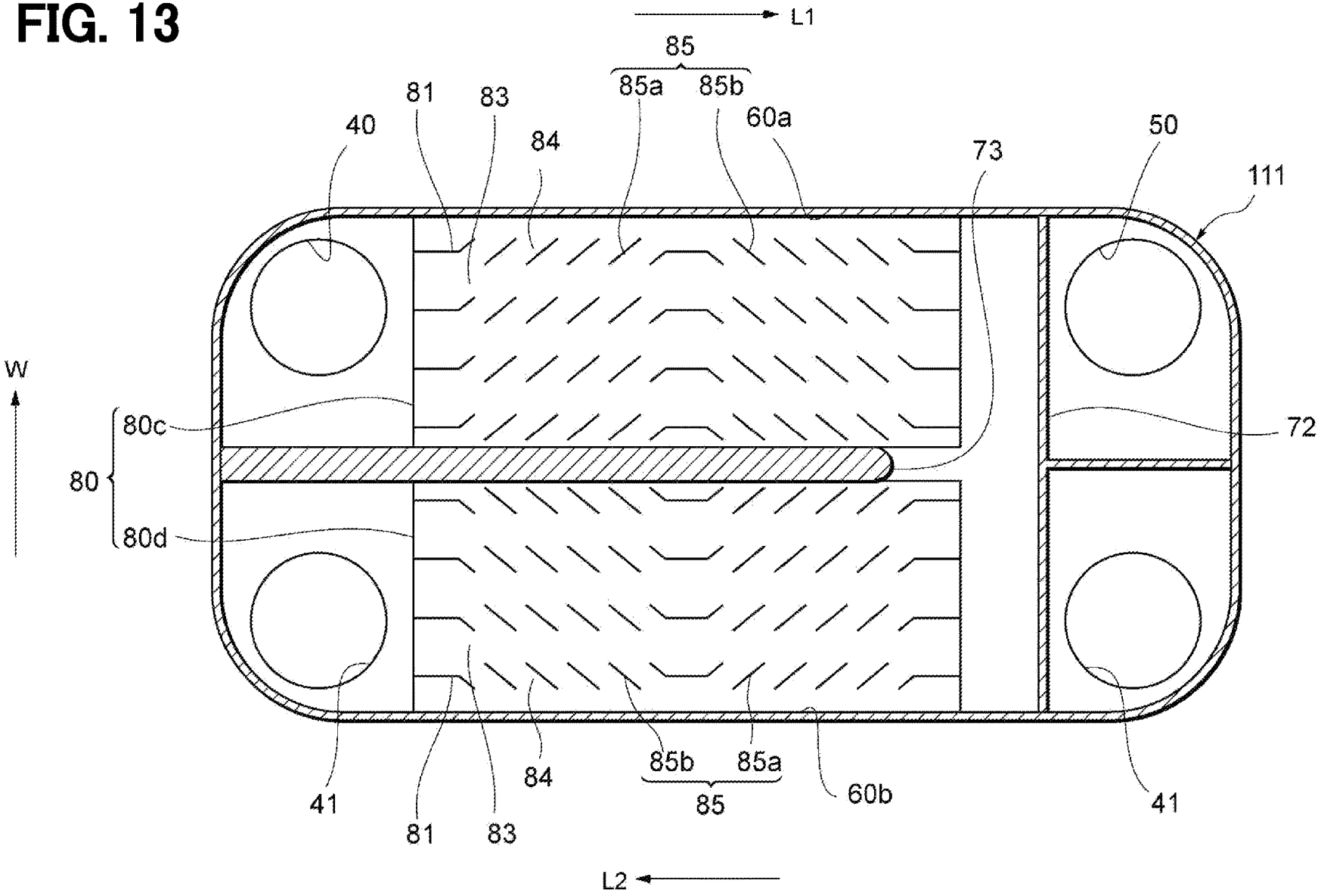
FIG. 13 is a cross-sectional view showing a refrigerant plate member of a fourth embodiment.

As shown in FIG. 13, the refrigerant inflow port 40 and the discharge port 41 are arranged along one longitudinal side of the refrigerant plate member 111 of the present embodiment. Further, the communication holes 50 and 51 for the cooling water are arranged along the other longitudinal side of the refrigerant plate member 111.

A first refrigerant passage 60*a* and a second refrigerant passage 60*b* are partitioned by an inner wall 73 inside the refrigerant plate member 111. The inflow port 40 is formed at one end of the first refrigerant passage 60*a*. The discharge port 41 is formed at one end of the second refrigerant passage 60*b*. The first refrigerant passage 60*a* and the second refrigerant passage 60*b* are communicated with each other at the other ends. The inner fins 80*c* and 80*d* are arranged in the refrigerant passages 60*a* and 60*b*, respectively. The structure of the inner fin 80*c*, 80*d* is the same as the inner fin 80 of the first embodiment.

In the refrigerant plate member 111 of the present embodiment, the refrigerant that has flowed into the first refrigerant passage 60*a* from the inflow port 40 flows in the direction indicated by the arrow L1. After that, the refrigerant flows from the other end of the first refrigerant passage 60*a* into the other end of the second refrigerant passage 60*b*, flows through the second refrigerant passage 60*b* in the direction indicated by the arrow L2, and then is discharged from the discharge port 41.

In the heat exchanger 10 having such a refrigerant plate member 111, the flow direction of the refrigerant flowing through the refrigerant passage 60 can be changed in the width direction W by using the inner fin 80*c*, 80*d* as shown in FIG. 13. Thus, the distributability of the refrigerant can be improved.

Fifth Embodiment

Next, a fifth embodiment of the heat exchanger 10 will be described. Hereinafter, the differences from the heat exchanger 10 of the first embodiment will be mainly described.

Figure 14:
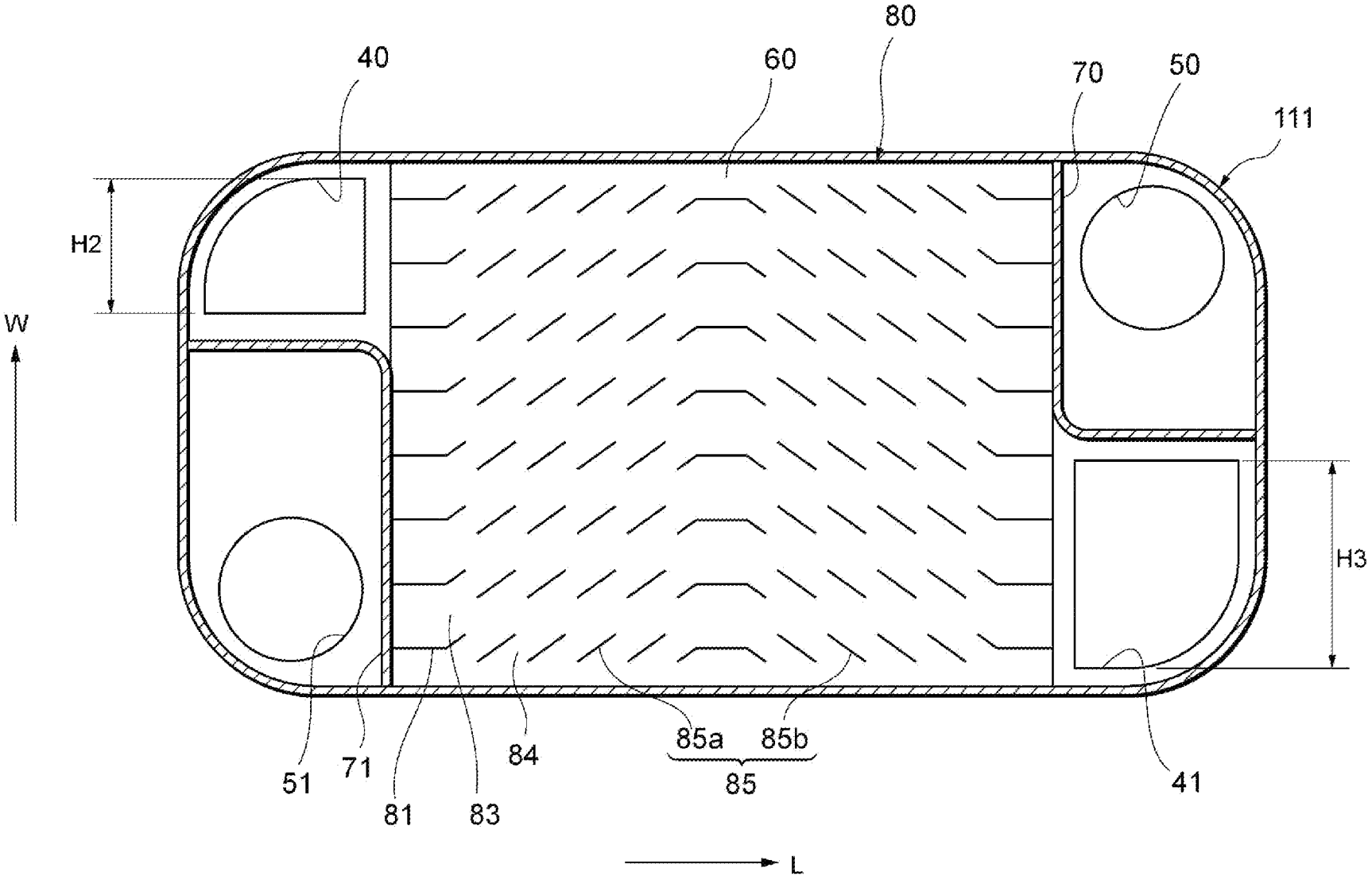
FIG. 14 is a cross-sectional view showing a refrigerant plate member of a fifth embodiment.

As shown in FIG. 14, in the refrigerant plate member 111 of the present embodiment, each of the inflow port 40 and the discharge port 41 is formed in a substantially rectangular shape. The width H3 of the discharge port 41 is longer than the width H2 of the inflow port 40. In the heat exchanger 10 having such a structure, it is effective to arrange the inner fin 80 described in the first embodiment.

Sixth Embodiment

Next, a sixth embodiment of the heat exchanger 10 will be described. Hereinafter, the differences from the heat exchanger 10 of the fifth embodiment will be mainly described.

Figure 15:
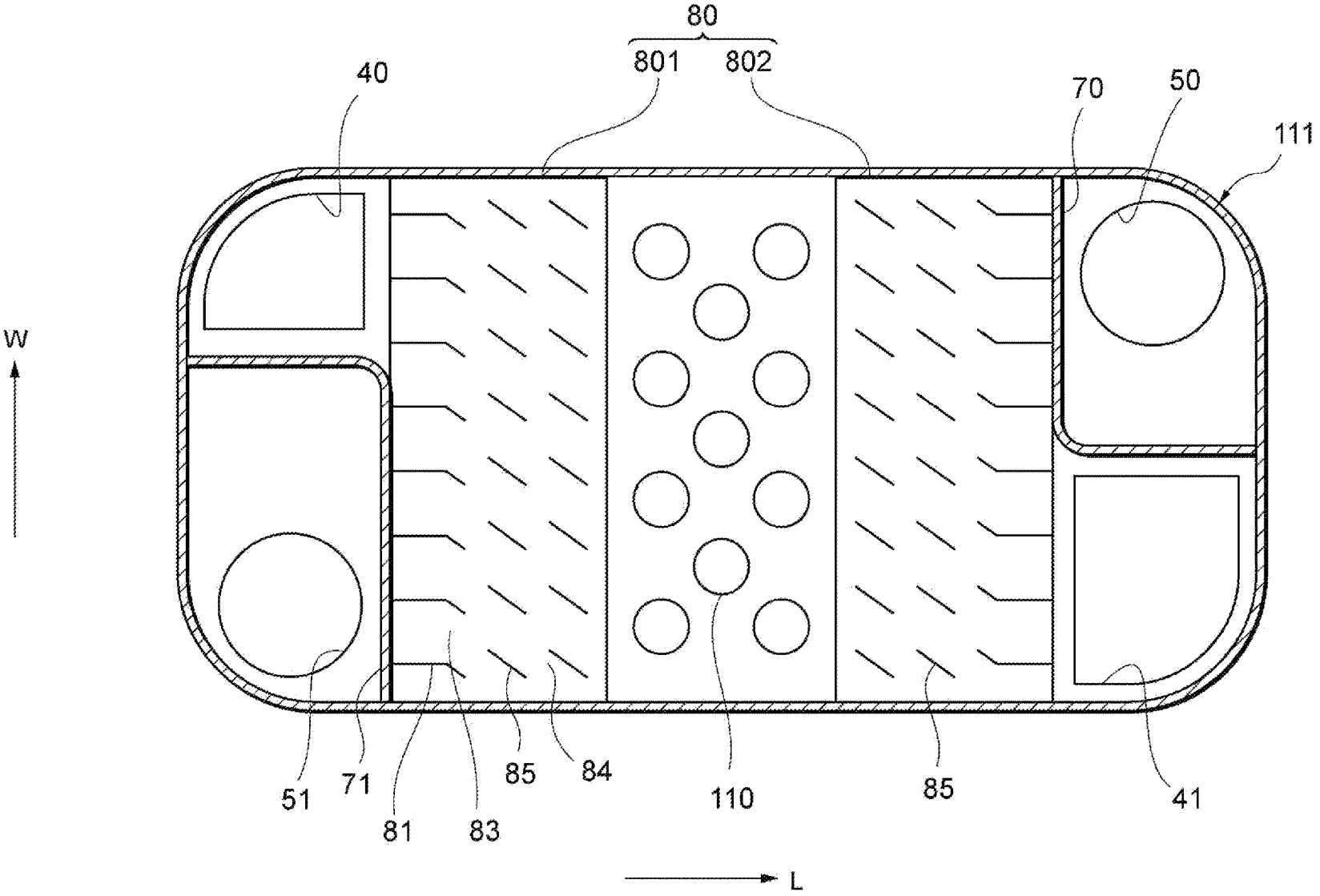
FIG. 15 is a cross-sectional view showing a refrigerant plate member of a sixth embodiment.

As shown in FIG. 15, in the heat exchanger 10 of the present embodiment, the inner fin 80 is divided into a first fin piece 801 and a second fin piece 802, as in the heat exchanger 10 illustrated in FIG. 9. A gap is formed between the first fin piece 801 and the second fin piece 802.

Plural protrusions 110 are formed on the bottom surface of the refrigerant plate member 111 so as to be located in the gap between the first fin piece 801 and the second fin piece 802. The protrusion 110 on the refrigerant plate member 111 can increase the heat transfer area of the refrigerant plate member 111, so that the heat transfer property of the refrigerant can be promoted.

Seventh Embodiment

Next, a seventh embodiment of the heat exchanger 10 will be described. Hereinafter, the differences from the heat exchanger 10 of the first embodiment will be mainly described.

Figure 16:
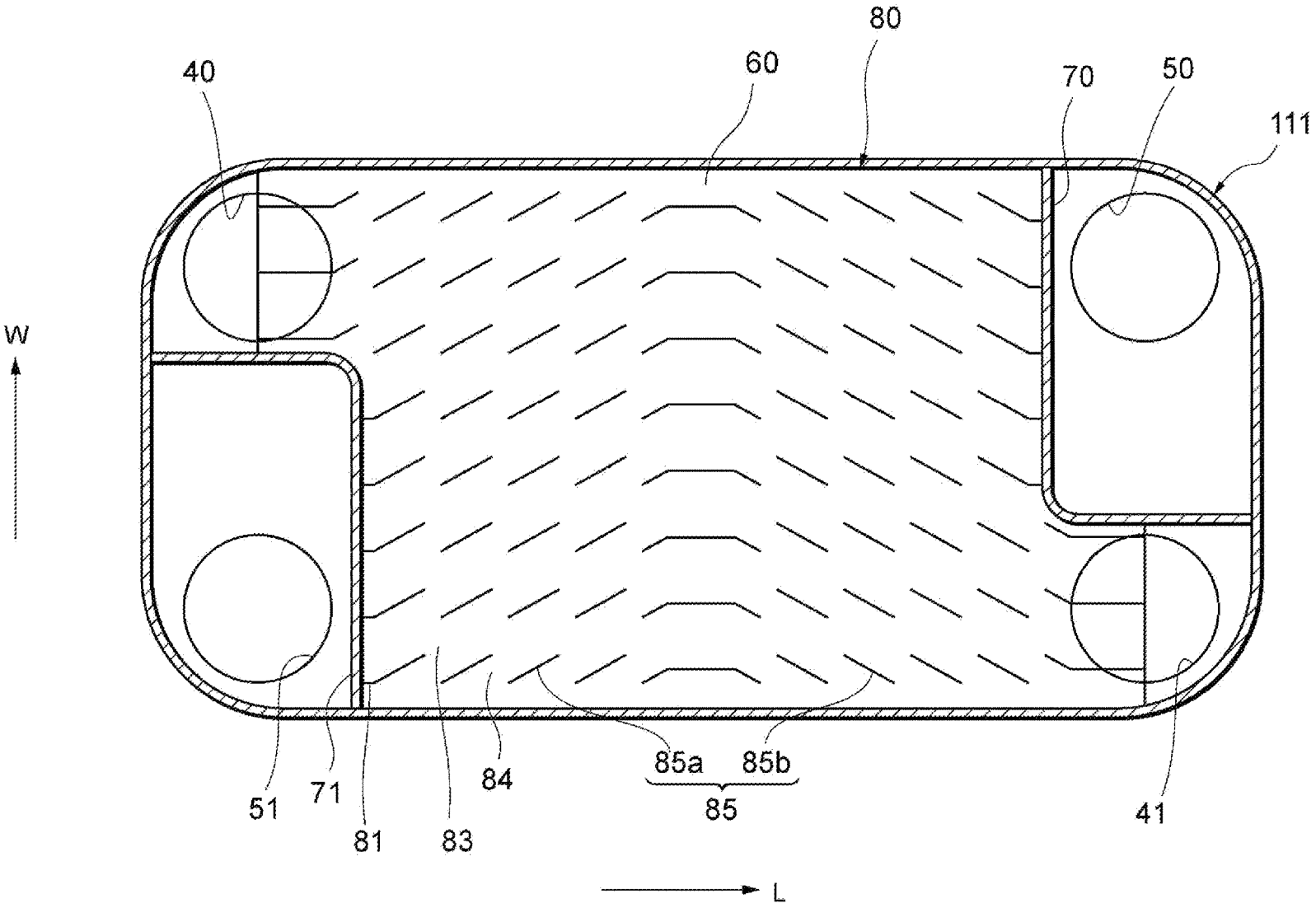
FIG. 16 is a cross-sectional view showing a refrigerant plate member of a seventh embodiment.

As shown in FIG. 16, in the heat exchanger 10 of the present embodiment, the inner fin 80 is arranged so as to overlap a part of the inflow port 40 and a part of the discharge port 41. In the heat exchanger 10 having such a structure, it is effective to arrange the inner fin 80 described in the first embodiment.

The ends of the inner fin 80 may be processed in the direction indicated by the arrow L to have a shape that matches the shape of the inflow port 40 and the discharge port 41.

Eighth Embodiment

Next, an eighth embodiment of the heat exchanger 10 will be described. Hereinafter, the differences from the heat exchanger 10 of the above embodiments will be mainly described.

The heat exchanger 10 is used as a so-called evaporator in which the cooling water is cooled while the refrigerant evaporates by exchanging heat between the cooling water and the refrigerant. The heat exchanger 10 of the present embodiment is used as a so-called condenser in which the refrigerant is cooled and condensed by cooling water. It is possible to apply the structure of the heat exchanger 10 of the first to seventh embodiments to the heat exchanger 10 used as the condenser. In the heat exchanger 10 used as a condenser, for example, the gas-phase refrigerant flows into the refrigerant inflow pipe 20. The gas-phase refrigerant flowing into the refrigerant inflow pipe 20 is cooled and condensed by exchanging heat with the cooling water flowing through the cooling water plate member 112 when flowing through the refrigerant passage 60 of the refrigerant plate member 111. The condensed liquid-phase refrigerant is discharged from the refrigerant discharge pipe 21.

When the heat exchanger 10 is used as a condenser in this way, it is effective to use the inner fin 80 as shown in FIG. 7. The reasons are described as follows.

In the heat exchanger 10 used as a condenser, the proportion of the gas-phase refrigerant is larger than that of the liquid-phase refrigerant on the upstream side of the refrigerant passage 60 near the inflow port 40. Therefore, regarding the pressure loss of the refrigerant flowing in the width direction W, the pressure loss on the upstream side is larger than the pressure loss on the downstream side of the refrigerant passage 60. In the heat exchanger 10, if the inner fin 80 having the inclined surface 85 as shown in FIG. 7 is used, the gas-phase refrigerant can be easily guided toward the discharge port 41 on the upstream side of the refrigerant passage 60. For example, the difference between the pressure loss of the refrigerant passing through the path P1 shown in FIG. 7 and the pressure loss of the refrigerant passing through the path P2 can be reduced. That is, since the pressure loss difference between the paths can be reduced, the distributability of the liquid-phase refrigerant in the refrigerant passage 60 can be improved.

Ninth Embodiment

Next, a ninth embodiment of the heat exchanger 10 will be described. Hereinafter, the differences from the heat exchanger 10 of the eighth embodiment will be mainly described.

Figure 17:
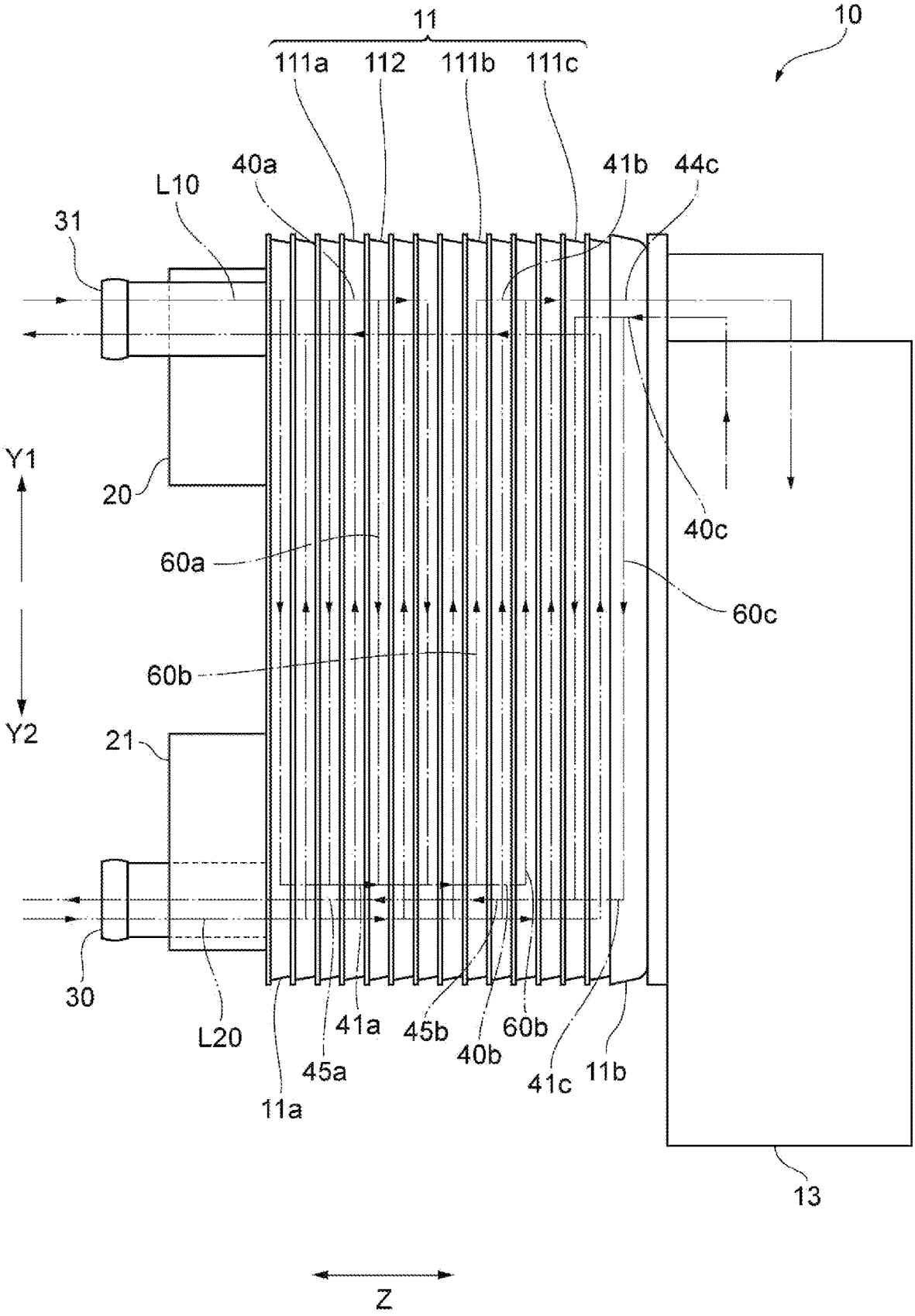
FIG. 17 is a front view showing a front structure of a heat exchanger according to a ninth embodiment.

The heat exchanger 10 of the present embodiment has a structure as shown in FIG. 17. The heat exchanger 10 of the present embodiment shown in FIG. 17 is used as a condenser like the heat exchanger 10 of the eighth embodiment. In FIG. 17, the plate members 11 have an end plate member 11*a* provided with the pipes 20, 21, 30, 31 and the other end plate member 11*b* located opposite to the end plate members 11*a*. Further, in FIG. 17, the direction indicated by the arrow Y1 indicates "upward in the vertical direction", and the direction indicated by the arrow Y2 indicates "downward in the vertical direction".

As shown in FIG. 17, the receiver 13 is assembled to the other end plate member 11*b* in the heat exchanger 10. The receiver 13 has a storage portion where the refrigerant flowing inside the heat exchanger 10 is temporarily stored, and separates the refrigerant into a gas-phase refrigerant and a liquid-phase refrigerant.

The heat exchanger 10 has three types of refrigerant plate members 111*a* to 111*c*. The refrigerant plate members 111*a* to 111*c* are arranged in this order from the end plate member 11*a* toward the other end plate member 11*b*.

Figure 18:
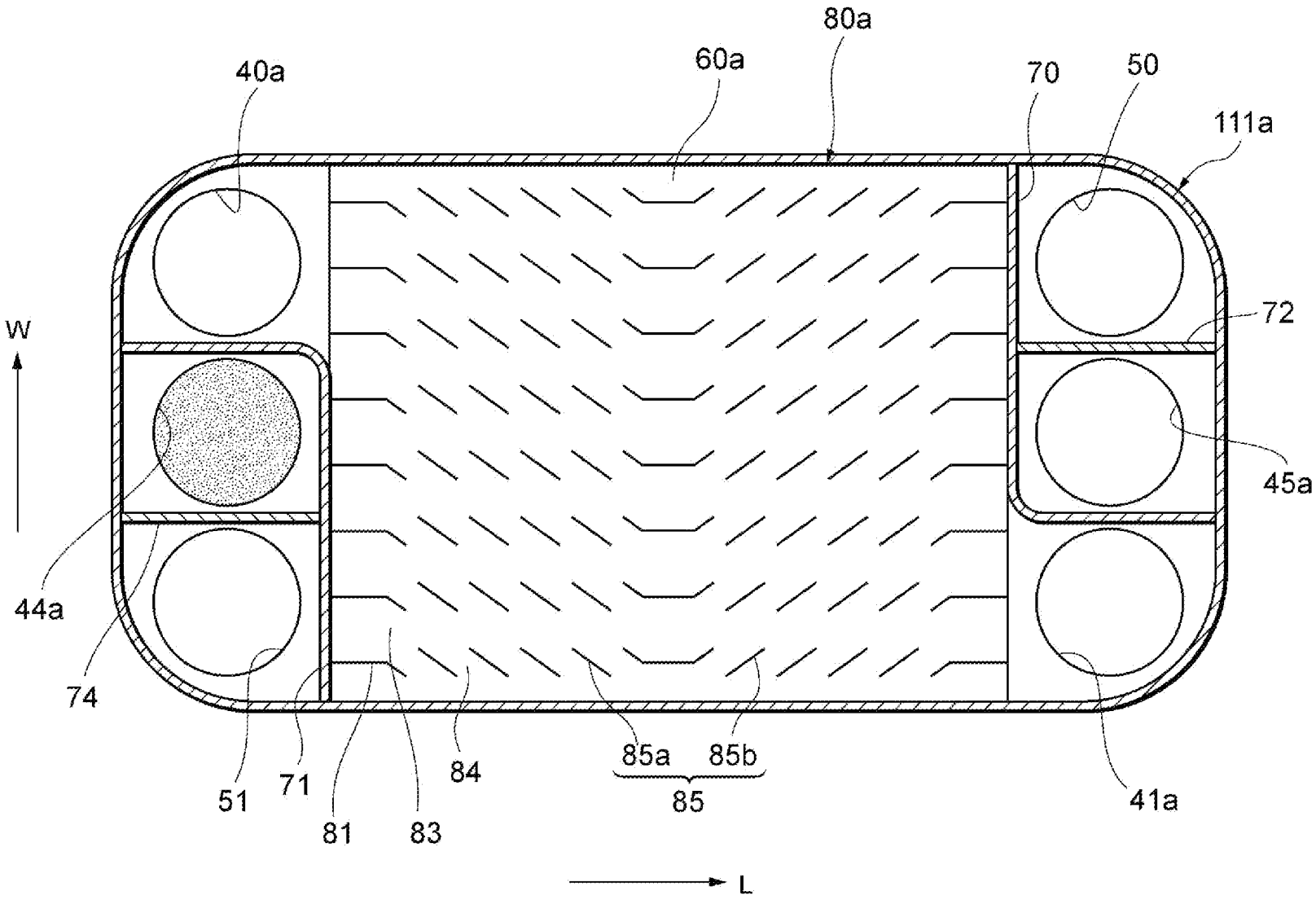
FIG. 18 is a cross-sectional view showing a first refrigerant plate member of the ninth embodiment.

As shown in FIG. 18, the inflow port 40*a* and the discharge port 41*a* for the refrigerant are formed at the two diagonal corners of the first refrigerant plate member 111*a*, respectively. A communication hole 44*a* for the refrigerant is formed between the inflow port 40*a* for the refrigerant and the communication hole 51 for the cooling water. The communication hole 51 for the cooling water and the communication hole 44*a* for the refrigerant are provided in two independent spaces partitioned by the partition wall 71, 74, respectively. A communication hole 45*a* for the refrigerant is formed between the discharge port 41*a* for the refrigerant and the communication hole 50 for the cooling water. The communication hole 50 for the cooling water and the communication hole 45*a* for the refrigerant are provided in two independent spaces partitioned by the partition wall 70, 72, respectively.

Figure 19:
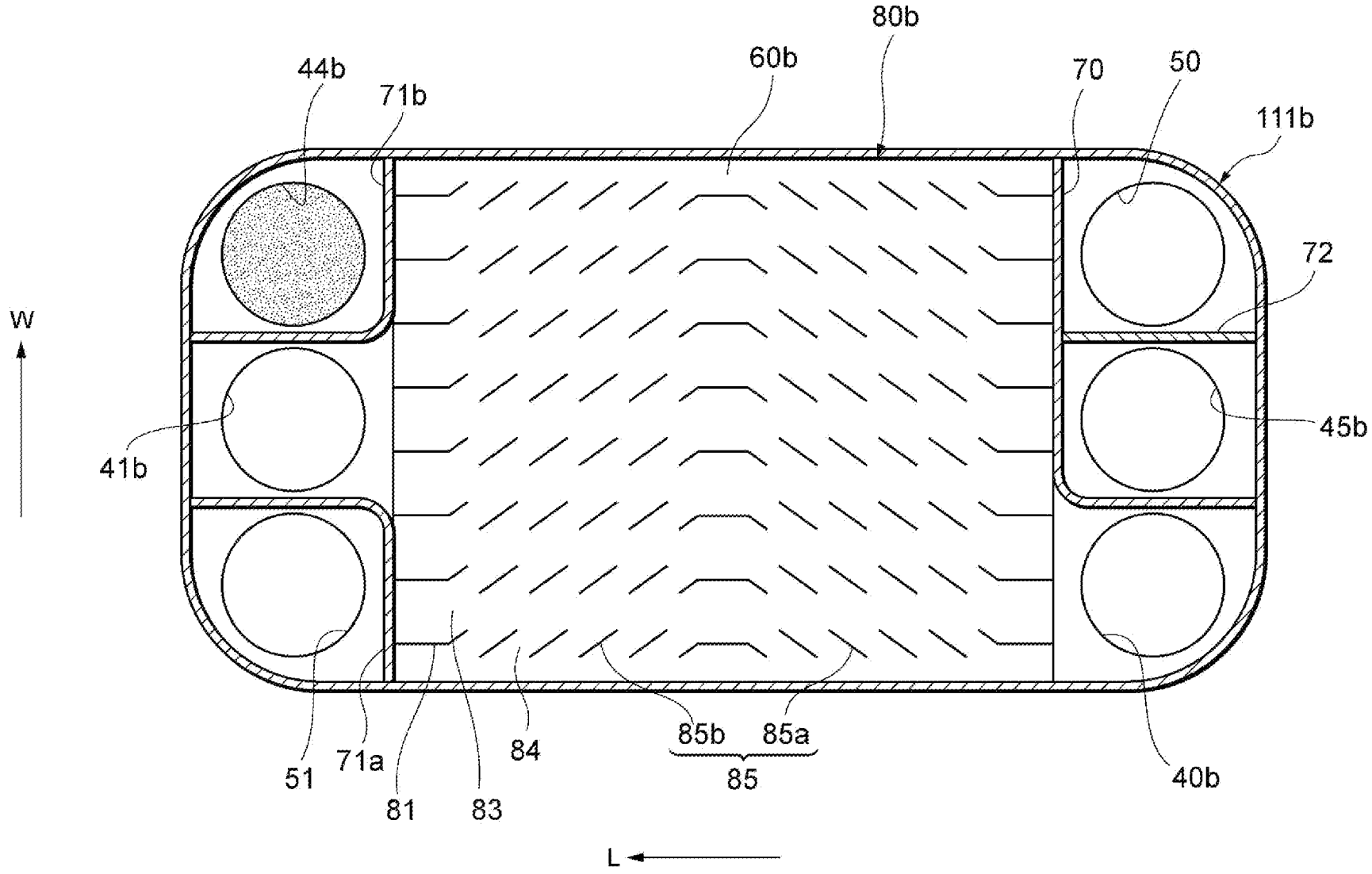
FIG. 19 is a cross-sectional view showing a second refrigerant plate member of the ninth embodiment.

As shown in FIG. 19, the inflow port 40*b* for the refrigerant and the communication hole 44*b* are formed at the two diagonal corners of the second refrigerant plate member 111*b*, respectively. A communication hole 45*b* for the refrigerant is formed between the inflow port 40*b* for the refrigerant and the communication hole 50 for the cooling water. The communication hole 50 for the cooling water and the communication hole 45*b* for the refrigerant are provided in two independent spaces partitioned by the partition wall 70, 72, respectively. A discharge port 41*b* is formed between the communication hole 44*b* for the refrigerant and the communication hole 51 for the cooling water. The communication hole 44*b* for the refrigerant and the communication hole 51 for the cooling water are provided in two independent spaces partitioned by the partition wall 71*a*, 71*b*, respectively.

Figure 20:
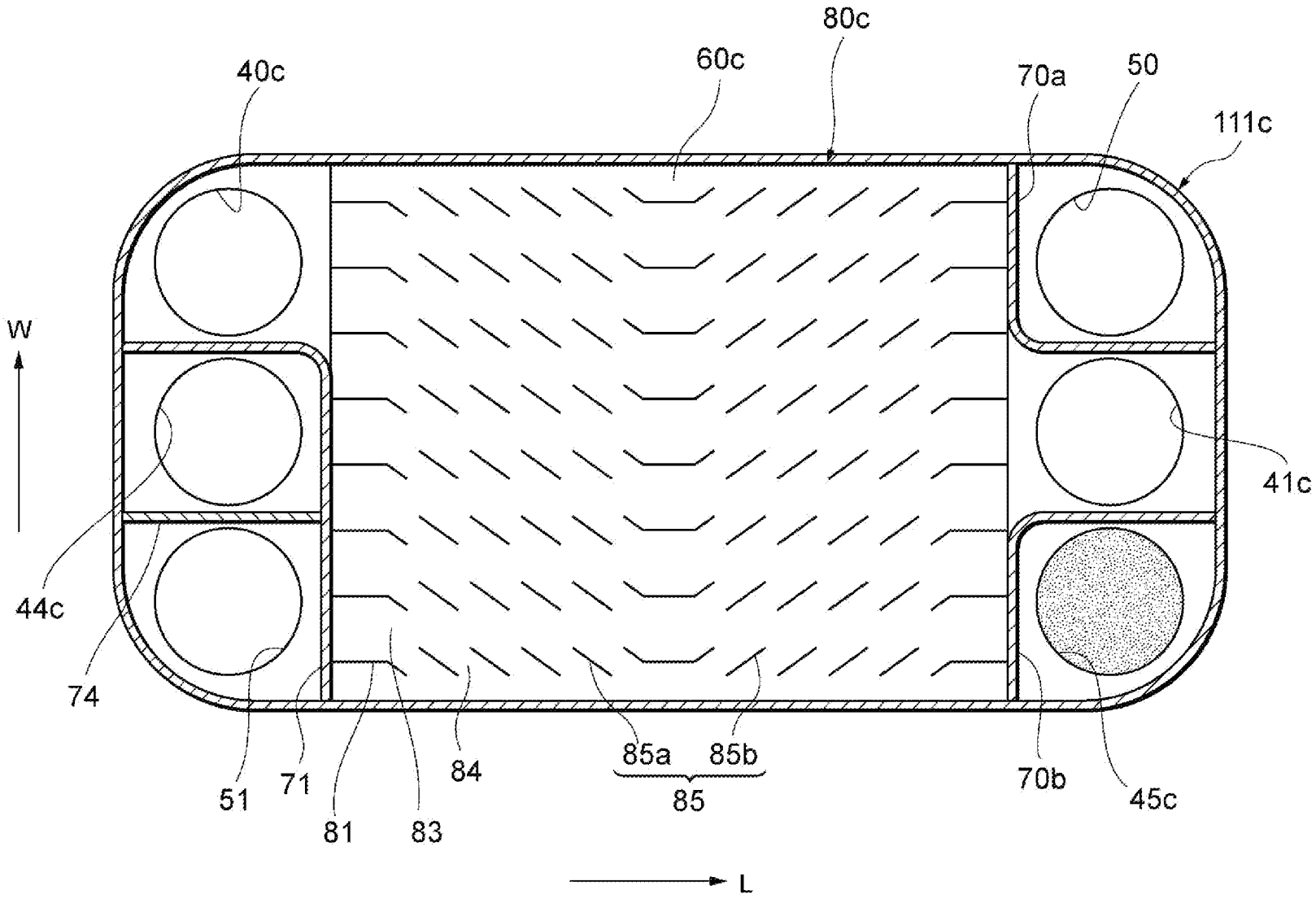
FIG. 20 is a cross-sectional view showing a third refrigerant plate member of the ninth embodiment.

As shown in FIG. 20, the inflow port 40*c* for the refrigerant and the communication hole 45*c* are formed at the two diagonal corners of the third refrigerant plate member 111*c*, respectively. A communication hole 44*c* for the refrigerant is formed between the inflow port 40*c* for the refrigerant and the communication hole 51 for the cooling water. The communication hole 51 for the cooling water and the communication hole 44*c* for the refrigerant are provided in two independent spaces partitioned by the partition wall 71, 74, respectively. A discharge port 41*c* for the refrigerant is formed between the communication hole 45*c* for the refrigerant and the communication hole 50 for the cooling water. The communication hole 45*c* for the refrigerant and the communication hole 50 for the cooling water are provided in two independent spaces partitioned by the partition wall 70*a*, 70*b*, respectively.

In FIGS. 18 to 20, the hatching represents the closed hole in the refrigerant plate members 111*a* to 111*c*. That is, in the first refrigerant plate member 111*a* shown in FIG. 18, the communication hole 44*a* for the refrigerant is closed. Further, in the second refrigerant plate member 111*b* shown in FIG. 19, the communication hole 44*b* for the refrigerant is closed. Further, in the third refrigerant plate member 111*c* shown in FIG. 20, the communication hole 45*c* for the refrigerant is closed.

Further, the refrigerant passages 60*a* to 60*c* are formed in the refrigerant plate members 111*a* to 111*c* shown in FIGS. 18 to 20, respectively.

Further, in the heat exchanger 10, the discharge port 41*a* of the first refrigerant plate member 111*a* shown in FIG. 18 and the inflow port 40*b* of the second refrigerant plate member 111*b* shown in FIG. 19 are communicated with each other. Further, the discharge port 41*b* of the second refrigerant plate member 111*b* shown in FIG. 19 and the communication hole 44*c* of the third refrigerant plate member 111*c* shown in FIG. 20 are communicated with each other. Further, the communication hole 45*a* of the first refrigerant plate member 111*a* shown in FIG. 18, the communication hole 45*b* of the second refrigerant plate member 111*b* shown in FIG. 19, and the discharge port 41*c* of the third refrigerant plate member 111*c* shown in FIG. 20 are communicated with each other.

With the above structure, the refrigerant flows as shown by the single chain line L10 in FIG. 17. That is, in the heat exchanger 10, the gas-phase refrigerant introduced from the refrigerant inflow pipe 20 flows into the refrigerant passage 60*a* from the inflow port 40*a* of the first refrigerant plate member 111*a*, and then flows into the discharge port 41*a*. The refrigerant that has flowed into the discharge port 41*a* of the first refrigerant plate member 111*a* flows into the refrigerant passage 60*b* from the inflow port 40*b* of the second refrigerant plate member 111*b*, and then flows to the discharge port 41*b*. The refrigerant that has flowed into the discharge port 41*b* of the second refrigerant plate member 111*b* flows into the receiver 13 through the communication hole 44*c* of the third refrigerant plate member 111*c*. The gas-phase refrigerant introduced from the refrigerant inflow pipe 20 is cooled and condensed by exchanging heat with the cooling water flowing through the cooling water plate member 112 before reaching the receiver 13, so as to be a two-phase refrigerant in which the liquid-phase refrigerant and the liquid-phase refrigerant are mixed. In the receiver 13, the gas-phase refrigerant and the liquid-phase refrigerant are separated from each other. The liquid-phase refrigerant stored in the receiver 13 flows into the refrigerant passage 60*c* from the inflow port 40*c* of the third refrigerant plate member 111*c*, and then flows into the discharge port 41*c*. At this time, the liquid-phase refrigerant is supercooled by further exchanging heat with the cooling water flowing through the cooling water plate member 112. The refrigerant that has flowed into the discharge port 41*c* of the third refrigerant plate member 111*c* flows through the communication hole 45*b* of the second refrigerant plate member 111*b* and the communication hole 45*a* of the first refrigerant plate member 111*a* in this order, and then is discharged from the refrigerant discharge pipe 21.

In the heat exchanger 10, the inner fin 80*a* as shown in FIG. 18 is arranged in the refrigerant passage 60*a* of the first refrigerant plate member 111*a*. The first inclined surface 85*a* provided near the inflow port 40*a* in the inner fin 80*a* is inclined so as to change the flow direction of the refrigerant toward the discharge port 41*a*. Further, the second inclined surface 85*b* provided near the discharge port 41*a* in the inner fin 80*a* is inclined so as to change the flow direction of the refrigerant in a direction away from the discharge port 41*a*.

As shown in FIGS. 19 and 20, the inner fin 80*b*, 80*c* having the same shape as the inner fin 80*a* of the first refrigerant plate member 111*a* are arranged in the second refrigerant plate member 111*b* and the third refrigerant plate member 111*c*.

According to the heat exchanger 10, it is possible to more efficiently exchange heat between the refrigerant and the cooling water. Further, according to the heat exchanger 10 of the present embodiment, the pressure loss difference between the paths can be reduced as in the heat exchanger 10 of the eighth embodiment. Thus, it is possible to improve the distributability of the liquid-phase refrigerant in the refrigerant passage 60*a* to 60*c*.

Figure 21:
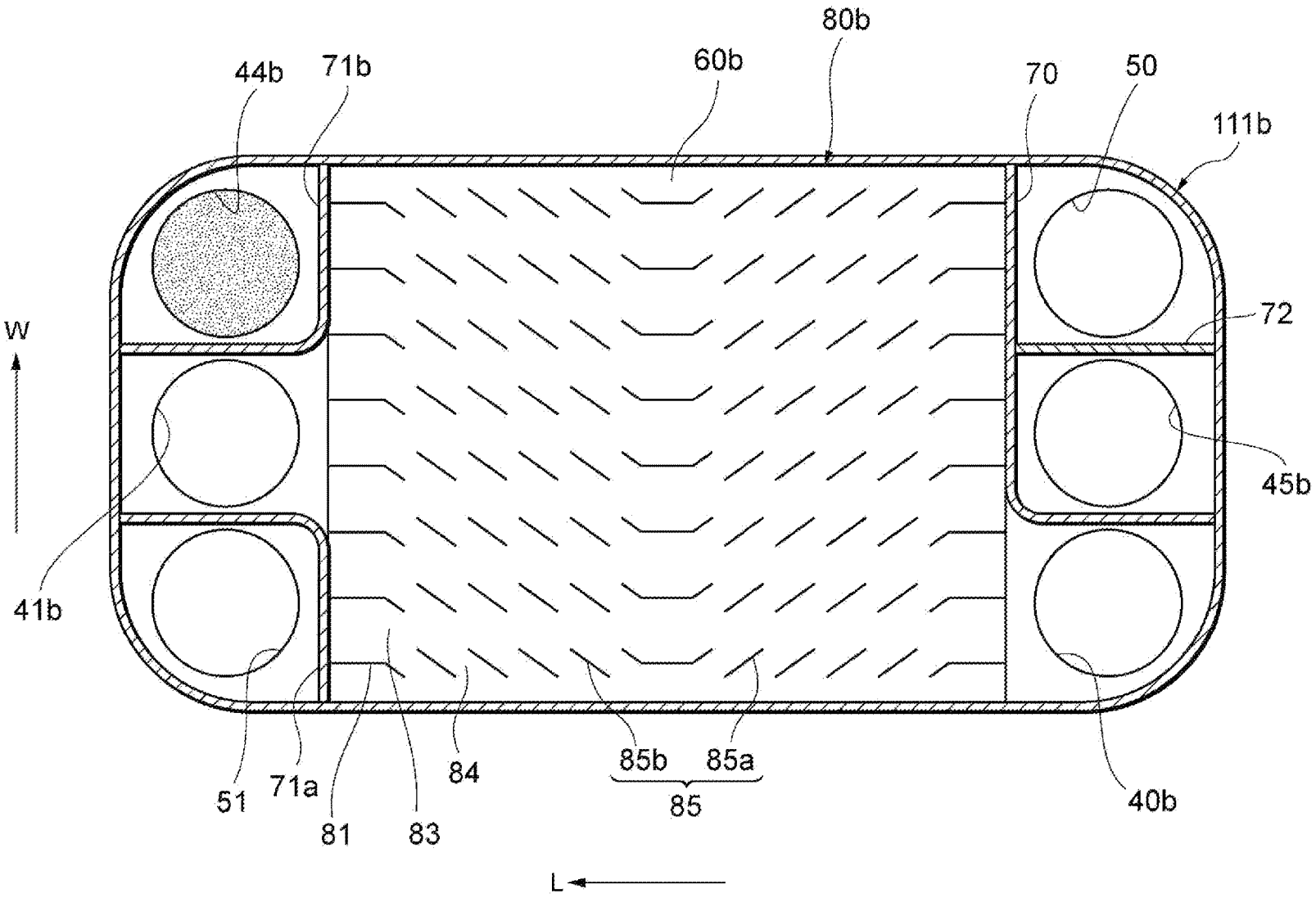
FIG. 21 is a cross-sectional view showing a modification of the second refrigerant plate member of the ninth embodiment.
Figure 22:
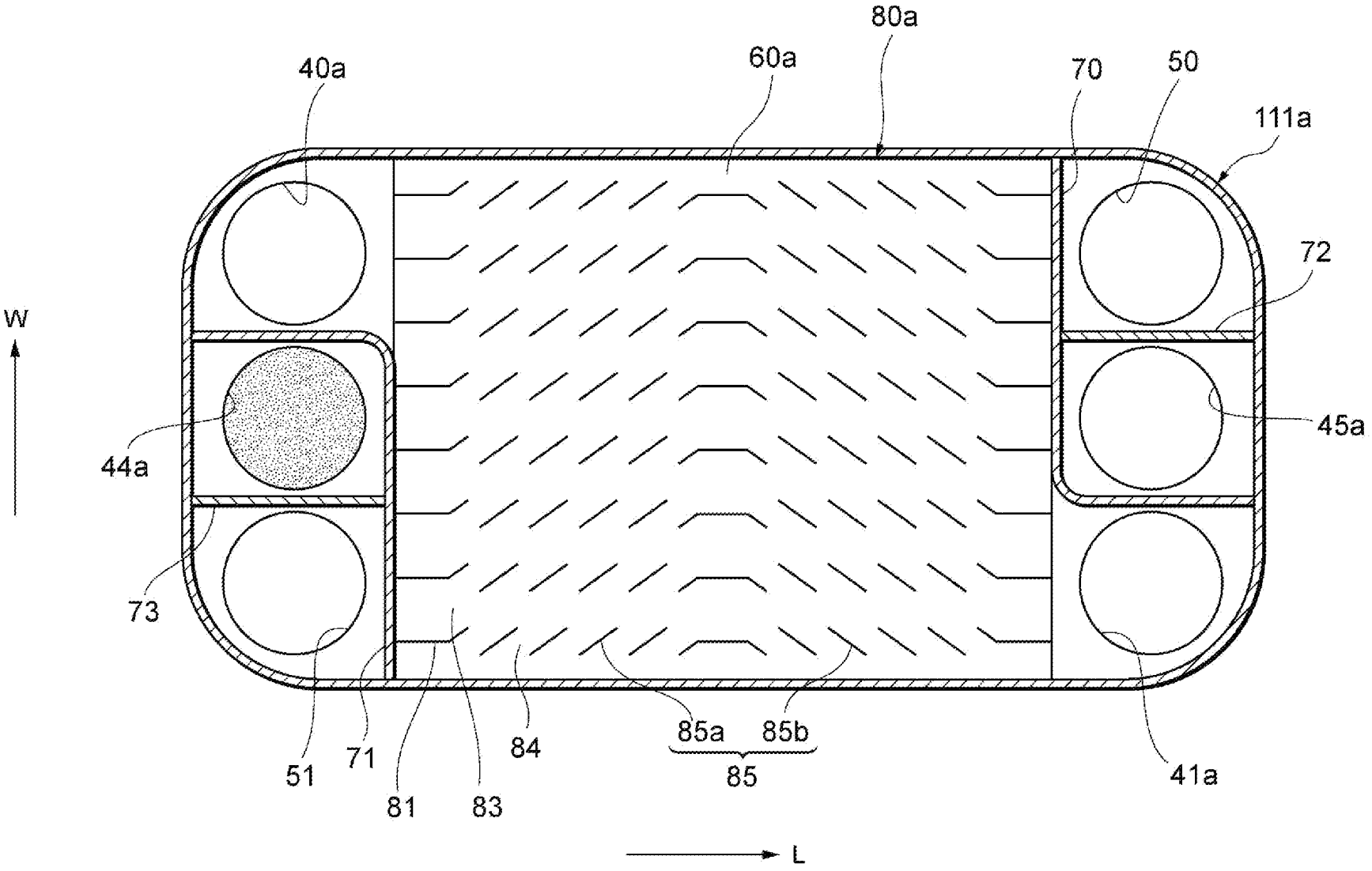
FIG. 22 is a cross-sectional view showing a modification of the first refrigerant plate member of the ninth embodiment.
Figure 23:
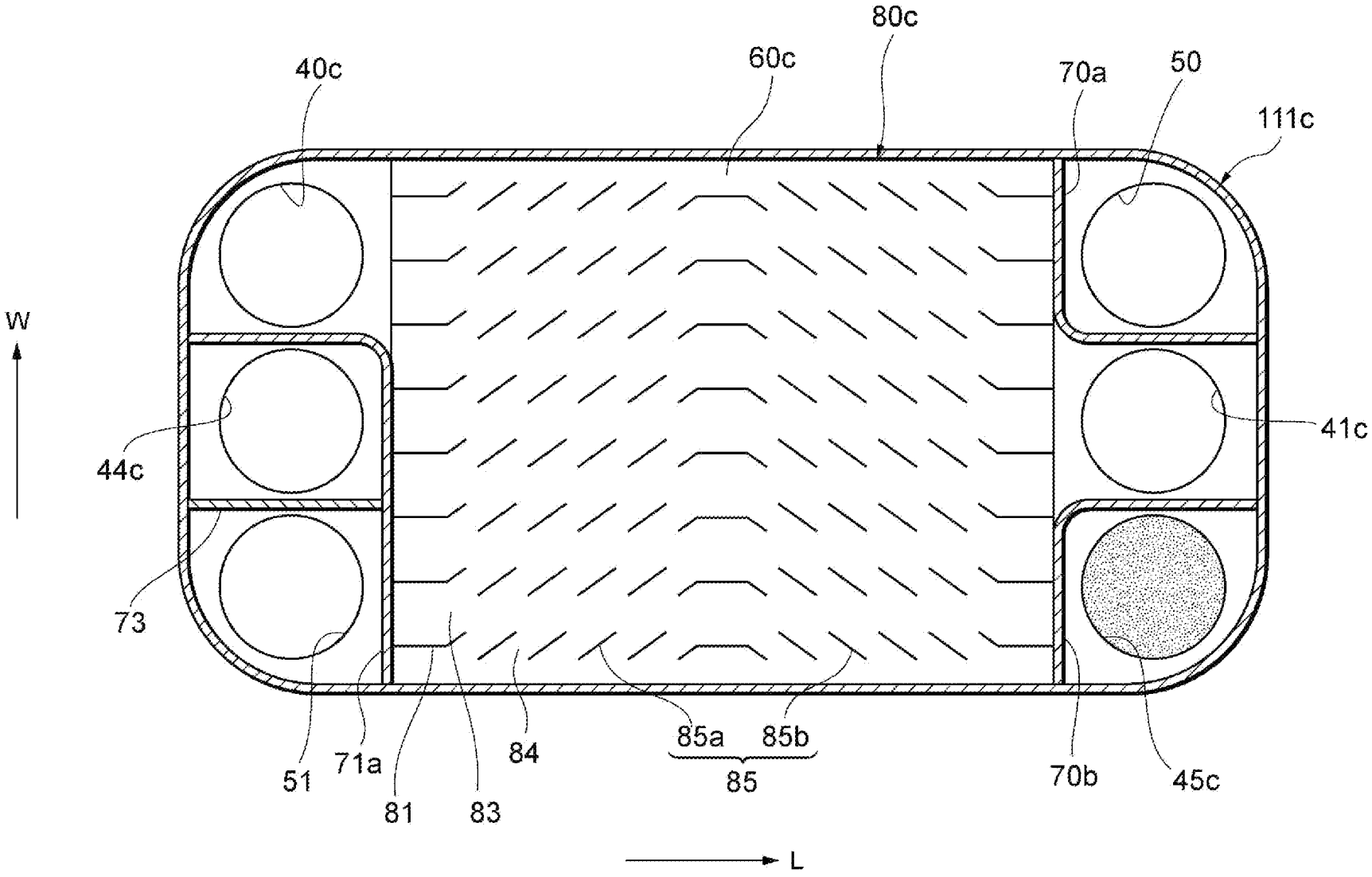
FIG. 23 is a cross-sectional view showing a modification of the third refrigerant plate member of the ninth embodiment.

The inner fins 80*a* to 80*c* may be arranged on the refrigerant plate members 111*a* to 111*c* so that the inclined surfaces 85 have the same orientation. Specifically, the inner fins 80*a*, 80*c* as shown in FIGS. 18 and 20 are arranged on the first refrigerant plate member 111*a* and the third refrigerant plate member 1*c*, and then the inner fins 80*b* as shown in FIG. 21 may be arranged on the second refrigerant plate member 111*b*. Further, in the heat exchanger 10, the inner fin 80*b* as shown in FIG. 19 is arranged on the second refrigerant plate member 111*b*, and then the inner fins 80*a*, 80*c* as shown in FIGS. 22 and 23 may be arranged on the first refrigerant plate member 111*a* and the third refrigerant plate member 1*c*. Accordingly, the inner fins 80*a* to 80*c* can be arranged in the same direction with respect to the refrigerant plate members 111*a* to 111*c*, so that the heat exchanger 10 can be easily manufactured.

Other Embodiment

The embodiments described above can be also implemented in the following forms.

The number of the openings 84 and the inclined surfaces 85, the inclination orientation and the inclination angle of the inclined surface 85, and the like can be arbitrarily changed in the inner fin 80, 80*a*, 80*b*, 80*c* of each embodiment.

The present disclosure is not limited to the specific examples described above. The specific examples described above which have been appropriately modified in design by those skilled in the art are also encompassed in the scope of the present disclosure so far as the modified specific examples have the features of the present disclosure. Each element included in each of the specific examples described above, and the placement, condition, shape, and the like of the element are not limited to those illustrated, and can be modified as appropriate.

The combinations of the elements in each of the specific examples described above can be changed as appropriate, as long as it is not technically contradictory.

What is claimed is:

1. A heat exchanger, which is an evaporator in which a plurality of plate members are stacked with each other to define a refrigerant passage and a fluid passage, a refrigerant flowing through the refrigerant passage and a fluid flowing through the fluid passage exchanging heat with each other, the heat exchanger comprising:

an inner fin arranged in the refrigerant passage, wherein the inner fin has a plurality of side wall portions formed to extend in a predetermined direction and arranged in parallel with each other, a gap formed between the side wall portions facing each other is a passage portion through which the refrigerant flows, each of the side wall portions has a plurality of openings arranged in the predetermined direction, a part of the side wall portion located between the openings adjacent to each other has an inclined surface inclined with respect to the predetermined direction, one end portion of the refrigerant passage in the predetermined direction has an inflow port through which the refrigerant flows into the refrigerant passage, the other end portion of the refrigerant passage in the predetermined direction has a discharge port through which the refrigerant flows out of the refrigerant passage, a part of the side wall portion located between the inflow port and a central portion in the predetermined direction has only an inclined surface that is inclined so as to change a flow direction of the refrigerant in a direction away from the discharge port, the part of the side wall portion extends continuously between the inflow port and the central portion, a part of the side wall portion located between the discharge port and the central portion in the predetermined direction has only an inclined surface that is inclined so as to change the flow direction of the refrigerant toward the discharge port, the part of the side wall portion extends continuously between the discharge port and the central portion, the inflow port and the discharge port are formed at two diagonal corners through the plate member, respectively, a width of the inflow port and a width of the discharge port are shorter than a width of the refrigerant passage, the inner fin is formed in a wavy shape and has a connecting portion connecting the side wall portions adjacent to each other, the opening and the inclined surface are not formed in the connecting portion, the opening and the inclined surface are formed only in the side wall portion, the connecting portion has a curved shape, the refrigerant is changed in phase from a liquid phase or a two-phase refrigerant, in which a liquid-phase refrigerant and a gas-phase refrigerant are mixed, to a gas phase, the inclined surface located adjacent to one of the two diagonal corners where the inflow port is formed is oriented such that the refrigerant flowing into the refrigerant passage from the inflow port flows along the inclined surface away from the discharge port located at the other of the two diagonal corners, and the inclined surface located adjacent to the discharge port is oriented such that the refrigerant flows along the inclined surface toward the discharge port.

2. The heat exchanger according to claim 1, wherein the inflow port is a through hole passing through the plate member and the discharge port is a through hole passing through the plate member.

3. The heat exchanger according to claim 1, further comprising a refrigerant inflow pipe and a refrigerant discharge pipe disposed on the plate member arranged at the uppermost position of the plate members, wherein the plurality of plate members include a refrigerant plate member and a fluid plate member, an inlet-side refrigerant tank is defined by the inflow port of the refrigerant plate member and a communication hole of the fluid plate member so as to distribute the refrigerant to the refrigerant passage, an outlet-side refrigerant tank is defined by the discharge port of the refrigerant plate member and a communication hole of the fluid plate member so as to collect the refrigerant flowing through the refrigerant passage, the communication hole of the fluid plate member is for communicating the inflow port of the refrigerant plate members adjacent to each other through the fluid plate member, and the communication hole of the fluid plate member is for communicating the discharge port of the refrigerant plate members adjacent to each other through the fluid plate member.

4. The heat exchanger according to claim 3, wherein the plurality of plate members are stacked with each other in a stacking direction, the refrigerant inflow pipe is located on the plate member arranged at the uppermost position of the plate members in the stacking direction, and located at one end of the plate member in a longitudinal direction of the plate member, the refrigerant discharge pipe is located on the plate member arranged at the uppermost position of the plate members in the stacking direction, and located at the other end of the plate member in the longitudinal direction of the plate member, the inlet-side refrigerant tank is located immediately under the refrigerant inflow pipe in the stacking direction, inside of the plate members stacked with each other, and the outlet-side refrigerant tank is located immediately under the refrigerant outflow pipe in the stacking direction, inside of the plate members stacked with each other.

5. The heat exchanger according to claim 3, further comprising:

a partition wall provided to partition the refrigerant passage and a first communication hole of the refrigerant plate member from each other, so as to suppress the refrigerant flowing through the refrigerant passage from flowing into the first communication hole and suppress the fluid flowing through the first communication hole from flowing into the refrigerant passage; and a partition wall provided to partition the refrigerant passage and a second communication hole of the refrigerant plate member, so as to suppress the refrigerant flowing through the refrigerant passage from flowing into the second communication hole and suppress the fluid flowing through the second communication hole from flowing into the refrigerant passage, wherein the first communication hole and the second communication hole are formed at the other two diagonal corners through the refrigerant plate member, respectively, for the fluid passage.

6. The heat exchanger according to claim 1, wherein the plurality of plate members include a refrigerant plate member, the refrigerant plate member having a plurality of protrusions formed thereon, the plurality of protrusions are located between the inclined surfaces of the side wall portion.

7. The heat exchanger according to claim 1, wherein the refrigerant passage is located between the inclined surfaces of the side wall portion.

8. The heat exchanger according to claim 1, wherein the central portion is located at a center of a length of the plate member in a longitudinal direction of the plate member.

9. The heat exchanger according to claim 1, wherein the inclined surfaces are continuously arranged in a width direction perpendicular to the predetermined direction.

10. The heat exchanger according to claim 1, wherein the refrigerant is changed in phase from a gas phase to a liquid phase.

11. The heat exchanger according to claim 1, wherein the inclined surface located adjacent to one of the two diagonal corners where the inflow port is formed is oriented such that the liquid phase or the two-phase refrigerant flowing into the refrigerant passage from the inflow port flows along the inclined surface away from the discharge port located at the other of the two diagonal corners, and the inclined surface located adjacent to the discharge port is oriented such that the gas phase refrigerant flows along the inclined surface toward the discharge port.

12. The heat exchanger according to claim 1, wherein a first region and a second region are located at the other two diagonal corners through the plate member and the inclined surfaces in the second region are oriented such that the refrigerant flows along the inclined surfaces toward the first region.

13. The heat exchanger according to claim 12, wherein the inclined surfaces in the first region are oriented to change the gas-phase refrigerant passing through the first region to flow outward of the first region such that the liquid-phase refrigerant flows into the first region, and the inclined surfaces in the second region are oriented to change the gas-phase refrigerant passing through the second region to flow outward of the second region such that the liquid-phase refrigerant flows into the second region.

* * * * *